US010625115B2

(12) United States Patent
Xu

(10) Patent No.: US 10,625,115 B2
(45) **Date of Patent: *Apr. 21, 2020**

(54) LOWER BACK EXERCISE APPARATUS

(71) Applicant: Tao Xu, Willowbrook, IL (US)

(72) Inventor: Tao Xu, Willowbrook, IL (US)

( * ) Notice: Subject to any disclaimer, the term of this patent is extended or adjusted under 35 U.S.C. 154(b) by 51 days.

This patent is subject to a terminal disclaimer.

(21) Appl. No.: 16/110,189

(22) Filed: Aug. 23, 2018

(65) Prior Publication Data

US 2018/0361199 A1 Dec. 20, 2018

Related U.S. Application Data

(62) Division of application No. 15/257,817, filed on Sep. 6, 2016, now Pat. No. 10,065,072.

(51) Int. Cl.

| | |
|---|---|
| ***A63B 23/02*** | (2006.01) |
| ***A61H 1/02*** | (2006.01) |
| ***A63B 22/16*** | (2006.01) |
| ***A63B 21/16*** | (2006.01) |
| ***A61H 1/00*** | (2006.01) |
| ***A63B 22/00*** | (2006.01) |
| ***A63B 22/20*** | (2006.01) |
| ***A63B 24/00*** | (2006.01) |

(52) U.S. Cl.

CPC ..... *A63B 23/0238* (2013.01); *A61H 1/005* (2013.01); *A61H 1/0292* (2013.01); *A63B 21/1609* (2015.10); *A63B 22/0087* (2013.01); *A63B 22/16* (2013.01); *A63B 22/201* (2013.01); *A63B 24/0087* (2013.01); *A61H 2201/1223* (2013.01); *A61H 2201/1269* (2013.01); *A61H 2201/1284* (2013.01); *A61H 2201/149* (2013.01); *A63B 2022/206* (2013.01); *A63B 2208/0233* (2013.01)

(58) Field of Classification Search

CPC ..... A63B 22/0087; A63B 22/201; A63B 23/0238; A63B 24/0087; A63B 2022/206

See application file for complete search history.

(56) References Cited

U.S. PATENT DOCUMENTS

| | | | | |
|---|---|---|---|---|
| 4,659,053 A | | 4/1987 | Holley | |
| 4,974,904 A | * | 12/1990 | Phillips | A47C 9/002 297/258.1 |
| 5,590,930 A | | 1/1997 | Glockl | |

(Continued)

*Primary Examiner* — Megan Anderson

(74) *Attorney, Agent, or Firm* — Christopher J. Scott

(57) ABSTRACT

A lower back exercise apparatus exercises or imparts laterally and upwardly directed movements into a user's lower back when seated thereupon. The lower back exercise apparatus includes a lower base assembly, an upper seat assembly, and a motor assembly. The lower base assembly includes an upper, laterally concave base surface. The upper seat assembly includes a lower, laterally convex seat surface and an upper seat surface. The upper seat assembly is laterally ridable upon and movable relative to the lower base assembly. The motor assembly is drives a laterally directed, cylindrical arc length trajectory of the upper seat assembly relative to the lower base assembly. The concave and convex surfacing have a common radius of curvature with a common fulcrum point spatially located adjacent an upper portion of a user's lumbar spinal region. Lateral flexion is thus imparted into a user's lower back when a user is seated thereupon.

12 Claims, 40 Drawing Sheets

(56) References Cited

U.S. PATENT DOCUMENTS

| | | | | |
|---|---|---|---|---|
| 5,728,049 | A | 3/1998 | Alberts | |
| 6,273,389 | B1 | 8/2001 | Carlgren | |
| 6,428,451 | B1 | 8/2002 | Hall | |
| 6,481,795 | B1 | 11/2002 | Pettibon | |
| 7,175,577 | B2 * | 2/2007 | Greenspan | A61H 1/0237 482/146 |
| 7,625,323 | B1 * | 12/2009 | Lin | A63B 21/015 482/112 |
| 8,182,036 | B2 | 5/2012 | Nishino | |
| 8,678,985 | B2 | 3/2014 | Mattox | |
| 9,186,542 | B2 * | 11/2015 | Shen | A63B 21/068 |
| 9,788,659 | B1 | 10/2017 | Jen | |
| 2007/0298947 | A1 * | 12/2007 | Eksteen | A63B 21/0004 482/141 |
| 2009/0230743 | A1 | 9/2009 | Derakhshan et al. | |
| 2014/0171835 | A1 | 6/2014 | Solomon et al. | |

* cited by examiner

LOWER BACK EXERCISE APPARATUS

PRIOR HISTORY

This application is a divisional patent application of pending U.S. patent application Ser. No. 15/257,817 filed in the United States Patent and Trademark Office on 6 Sep. 2016

BACKGROUND OF THE INVENTION

Field of the Invention

The present invention generally relates to an apparatus for imparting motion into a user's lower back. More particularly, the present invention relates to a lower back or lumbar spine exercise apparatus, which when sat upon by a human individual imparts periodic side-to-side motion for exercising the lower back or lumbar spine region of the seated human individual.

Brief Description of the Prior Art

U.S. Pat. No. 5,590,930 ('930 patent), issued to Glockl, discloses an Active Dynamic Seat (ADS). The '930 patent describes an active dynamic seat having a base, an intermediate part linked to the base and a seating part linked to the intermediate part. The seating part has on its lower side a shell-shaped, downwardly convex seating bowl. The seating part is supported in the vertical direction on a bearing arrangement arranged on a head part of the intermediate part that engages the shell-shaped lower side of the seating bowl, and is mounted so as to tilt in all other directions. It will be understood that the '930 patent contemplates a spherical bottom surface enabling the ADS to rock or roll in front-to-back and left-to-right or circular directions under the operation of forces directed thereinto by the user. All movements are selectively imparted into the device via the user as the origination source, and thus moves freely while a user is sitting on it.

U.S. Pat. No. 5,728,049 ('049 patent), issued to Alberts, discloses a Therapeutic Seating Apparatus. The '049 patent describes a seating apparatus having a seating surface that tilts in a full-circle manner. The tilt is controllable for allowing the user seated on the apparatus to change the alignment of body muscles and skeletal members, while avoiding a degree of movement which would be excessive, potentially uncomfortable and/or possibly disruptive. The apparatus incorporates a ball-and-socket arrangement providing for full circle tilting while also incorporating an appropriate stop surface for preventing excessive tilting along the full-circle rotation orientations. When used for extended periods of time, the seating apparatus improves, rather than detrimentally affects, muscle tone and flexibility, while also reducing risk of back injury and muscle stiffness due to prolonged sitting.

U.S. Pat. No. 6,481,795 ('795 patent), issued to Pettibon, discloses a Therapeutic Chair. The '795 patent describes a therapeutic chair having a seat, a base configured to rest on a surface, and a seat support mechanism configured to couple the seat to the base and to enable the seat to be rocked in any direction while resisting rocking of the seat. Ideally the seat-support mechanism permits universal motion in all directions about a vertical axis, including 360 degrees of rotation, 40 degrees of side-to-side flexion, and 35 degrees of front-to-back flexion on a universal-type joint. The joint includes a first support member having a projecting post and a second support member having a housing with first and second resilient members mounted therein and configured to slidably receive the post. A unique seat design in combination with the universal seat connector reduces pressure on the legs and facilitates therapeutic exercise when seated.

United States Patent Application Publication No. 2009/0230743, authored by Derakhshan et al., describes an exercise chair for aiding in the alleviation of lower back pain. The chair taught by Derakhshan et al. comprises a central post portion defining a central axis with a base at one end and a coupling portion fashioned to be tilted relative to the central axis at the other end. A coil spring is concentrically located on the central axis and affixed to the post portion at the one end and to the coupling portion at the other end. The coil spring is normally biased to maintain the seat of the chair in a non-tilted position.

U.S. Pat. No. 8,182,036 ('036 patent), issued to Nishino, discloses a so-called Rocking Chair. The '036 patent describes a rocking chair having a seat, a projecting member provided on the lower side of the seat and having a convex surface forming a part of a spherical surface centered on a point located above the seat, swivel casters in contact with the convex surface of the projecting member and guiding the projecting member such that the projecting member can rock along the spherical surface, and a support member for the chair. The swivel casters are mounted such that the axes of swivel shafts of the swivel casters pass through the center point of the spherical surface, and the seat is guided in the direction of a force applied by rollers of the swivel casters. Rocking of the projecting member is smoother than that in rocking chairs using ball casters instead of the swivel casters, and noise caused by rocking is drastically reduced.

The Rocking Chair contemplates a spherical bottom surface, however, in structural distinction to the present invention that incorporates a lateral arc length trajectory as in the case of a cylindrical curvature. Such a design thereby enables the Rocking Chair to "rock" in front to back and left to right directions under the operation of forces directed thereinto by the user. All movements are thus selectively imparted into the device via the user as the origination source, and thus moves freely while a user is sitting on it thereby raising safety issues for new and untrained users. Further, the Rocking Chair cannot be used as a stationary seat due to its free-rolling manner.

United States Patent Application Publication No. 2014/0171835, authored by Solomon et al., describes a portable back treatment apparatus comprising a support member arranged to support a lumbar region; a translation mechanism; and a control circuitry arranged to control the translation mechanism to translate the support member along a plurality of paths and rotate the support member about at least one axis in a pre-determined range of motion. Preferably, the plurality of paths is constituted of at least: a generally linear path along an axis generally perpendicular in relation to a plane defined by the support member; and a generally linear path along an axis generally parallel in relation to the plane defined by the support member.

As may be understood from a consideration of the foregoing, the prior art has shown a number of devices that operate to move the lower back of a user. It will be further understood, however, from a review of the foregoing, and the field of exercise chair devices and the like that the prior art perceives a need for a lower back exercise apparatus having an upper seat assembly movable relative to a lower base assembly along a cylindrical and fixed arc length trajectory in a side-to-side or in laterally repetitive or periodic displacements under the preferred operation of a motorized or mechanized source of directed force substantially as summarized hereinafter.

SUMMARY OF THE INVENTION

The present invention provides a lower back exercise apparatus essentially providing a seat assembly that rotates around an imaginary fixed point above the seat plane with a fixed radius in a cylindrical path very much akin to the trajectory of a massive bob of a pendulum. This kind of motion of the seat creates not only a tilting of the seat but also some lateral movement for the seat. The plane of the seat thus shifts laterally and upwardly as the seat moves laterally from the central stationary position at which position the user's spinal column is in substantial linear alignment.

This combined tilting and lateral movement generates a desirable "bending" movement for the lumbar spine region without the need of any upper body shift/movement by the user, but which movement is preferably imparted by way of a mechanized assembly in both the lateral and upward direction. In other words, the preferable mechanized assembly of the lower back exercise apparatus imparts the necessary driving force. This is in direct contradistinction to state of the art exercise devices that only involve a tilting of the seat plane. In such devices, the seat plane just rotates around itself, and the user's upper body is required to be laterally moved in order to have flexion of the lumbar spine region.

It will thus be understood that the moving part of the seat assembly according to the present invention is preferably powered by an electric motor assembly geared to a desirable moving speed and velocity pattern that may preferably be cyclic or periodic in form and function. In this regard, the moving frequency and moving amplitude can be varied through a control device in communication with the motor assembly. The periodicity and amplitude may thus be set controlled or governed by the end user.

The lower back exercise apparatus according to the present invention need not be in constant motion, however, and can be completely stationary when a person sits on it—a must-have safety feature. In this regard, it is contemplated that the seat can be used as a normal seat without motion. Further, the lower back exercise apparatus may be provided as a non-mechanized, manual version. All moving parts are concealed within the body or housing of the lower back exercise apparatus for safety, and the structural design of the apparatus is low profile, removable and portable. Optionally, the basic concepts can be built-in with a combination chair construction.

The lower back exercise apparatus according to the present invention thus enables or imparts laterally and upwardly directed movements into a user's lower back when a user is seated thereupon. The preferred lower back exercise apparatus includes a lower base assembly, an upper seat assembly, and a motor assembly. An alternative lower back exercise apparatus includes a lower base assembly and an upper seat assembly and eliminates the motor assembly as an option enhancement. The lower base assembly includes an upper, laterally concave base surface in all cases or embodiments. The upper seat assembly includes a lower, laterally convex seat surface and an upper seat surface in all cases or embodiments.

The upper seat assembly is laterally ridable upon and movable relative to the lower base assembly. The preferred and optional motor assembly drives a laterally directed, cylindrical arc length trajectory of the upper seat assembly relative to the lower base assembly. The concave and convex surfacing have a common radius of curvature with a common fulcrum point spatially located adjacent an upper portion of a user's lumbar spinal region. When the laterally directed, cylindrical arc length trajectory is mobilized, lateral flexion is thereby imparted into and isolated at a user's lower back when a user is seated thereupon.

BRIEF DESCRIPTIONS OF THE DRAWINGS

Other features of the invention will become more evident from a consideration of the following brief descriptions of the illustrations submitted in support of the subject invention:

Figure 1:
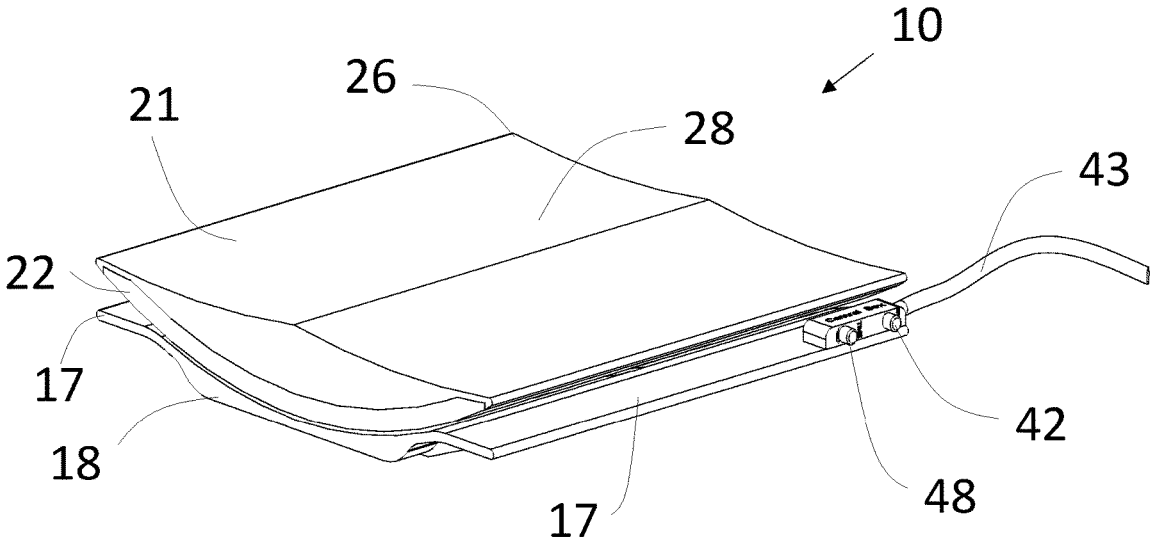
FIG. 1 is a top anterior perspective view of a generic embodiment of the lower back exercise apparatus according to the present invention showing a fragmentary power cord extending therefrom.
Figure 2:
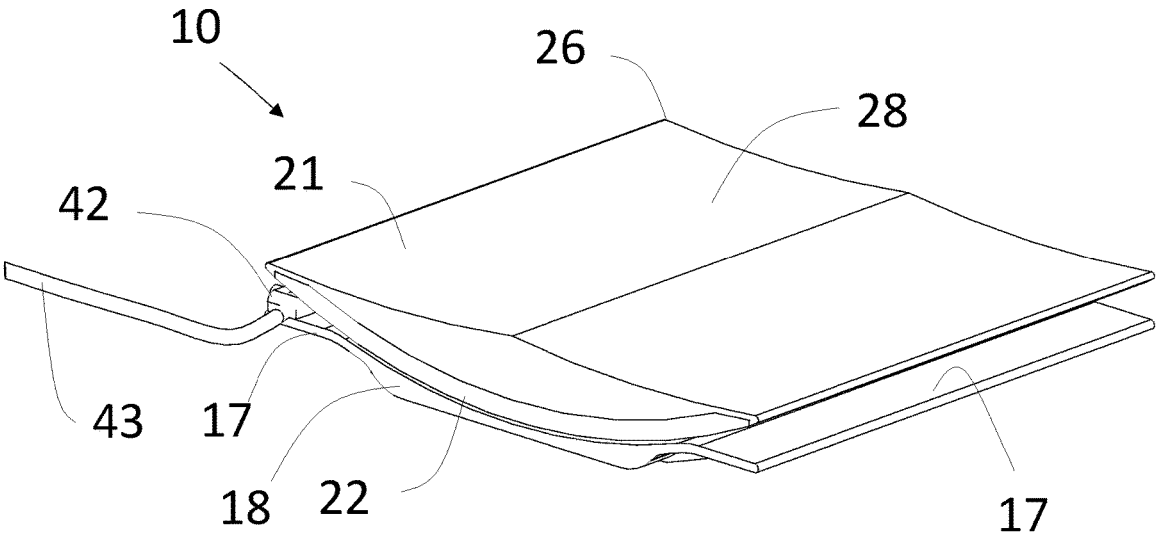
FIG. 2 is a top posterior perspective view of the generic embodiment of the lower back exercise apparatus according to the present invention showing a fragmentary power cord extending therefrom.
Figure 3:
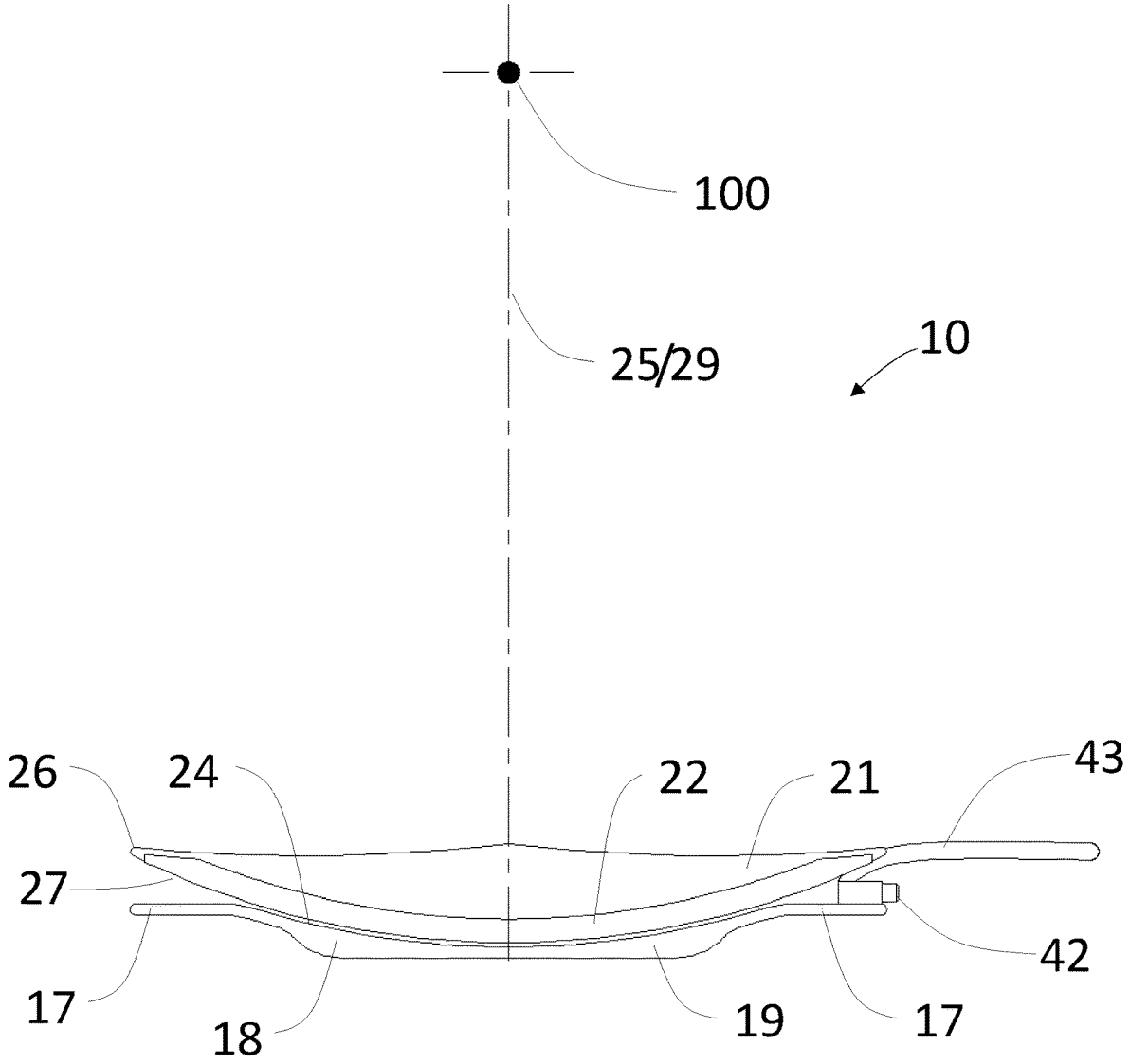
Figure 4:
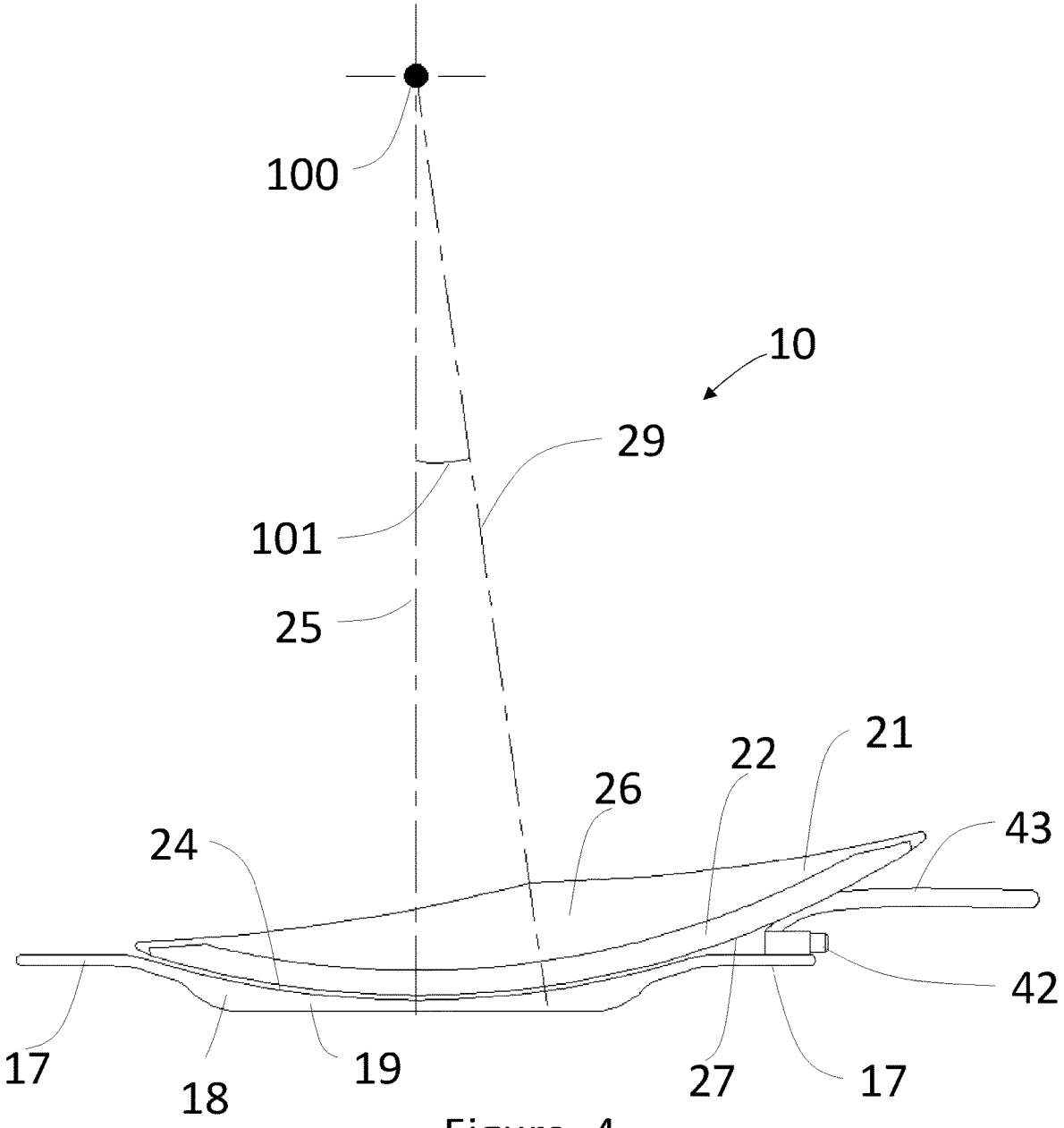
Figure 5:
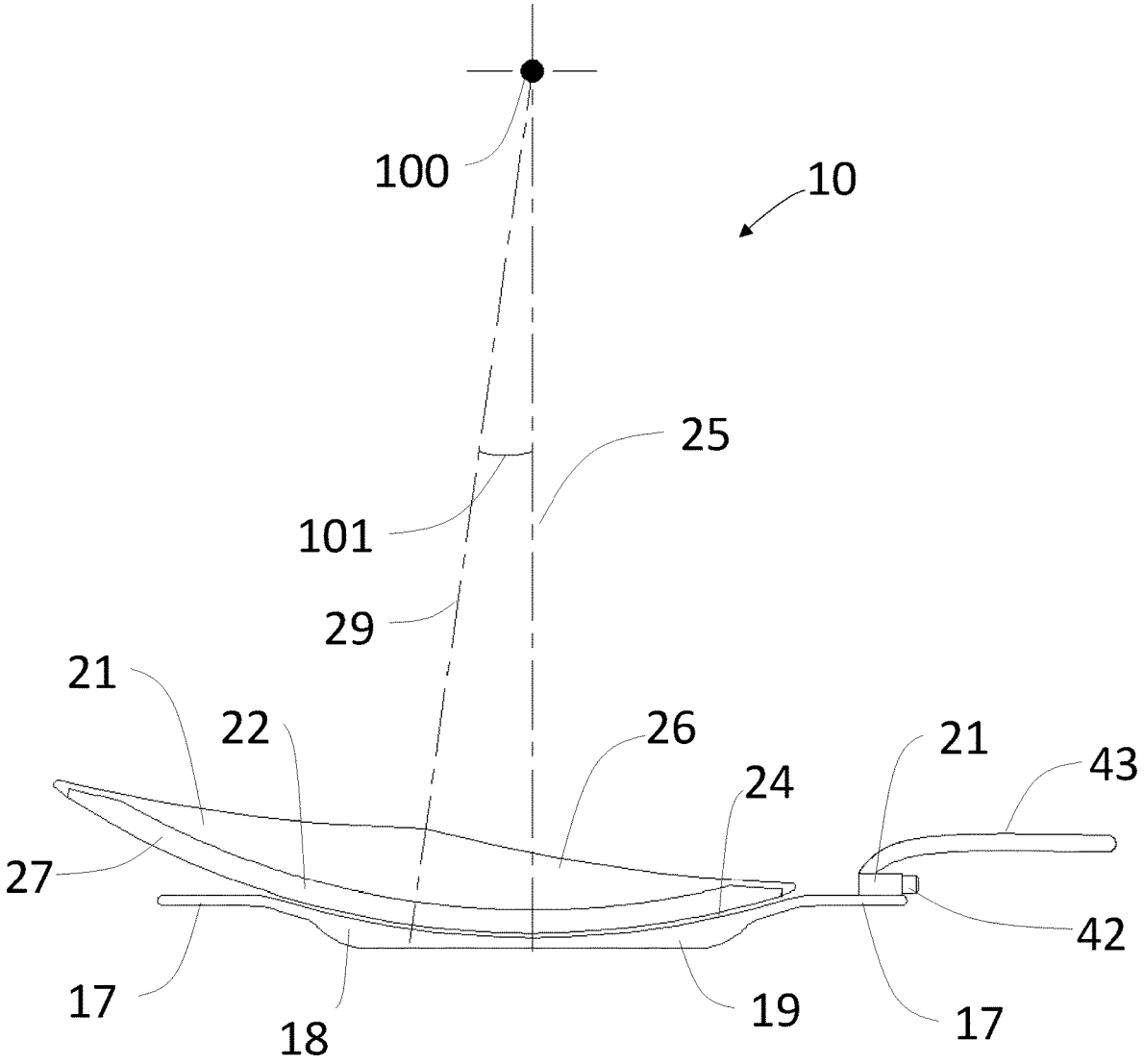

FIG. 3 is a first sequential diagrammatic depiction of the generic embodiment of the lower back exercise apparatus according to the present invention showing an upper seat assembly in a central equilibrium position relative to a lower base assembly, the upper seat assembly being movable relative to the lower base assembly in a pendulum swing type motion as generally and comparatively further depicted in FIGS. 4 and 5.

FIG. 4 is a second sequential diagrammatic depiction of the generic embodiment of the lower back exercise apparatus according to the present invention showing the upper seat assembly in a maximum left arc position relative to the lower base assembly, the upper seat assembly being movable relative to the lower base assembly in a pendulum swing type motion as generally and comparatively further depicted in FIGS. 3 and 5.

FIG. 5 is a third sequential diagrammatic depiction of the generic embodiment of the lower back exercise apparatus according to the present invention showing the upper seat assembly in a maximum right arc position relative to the lower base assembly, the upper seat assembly being movable relative to the lower base assembly in a pendulum swing type motion as generally and comparatively further depicted in FIGS. 3 and 4.

Figure 6:
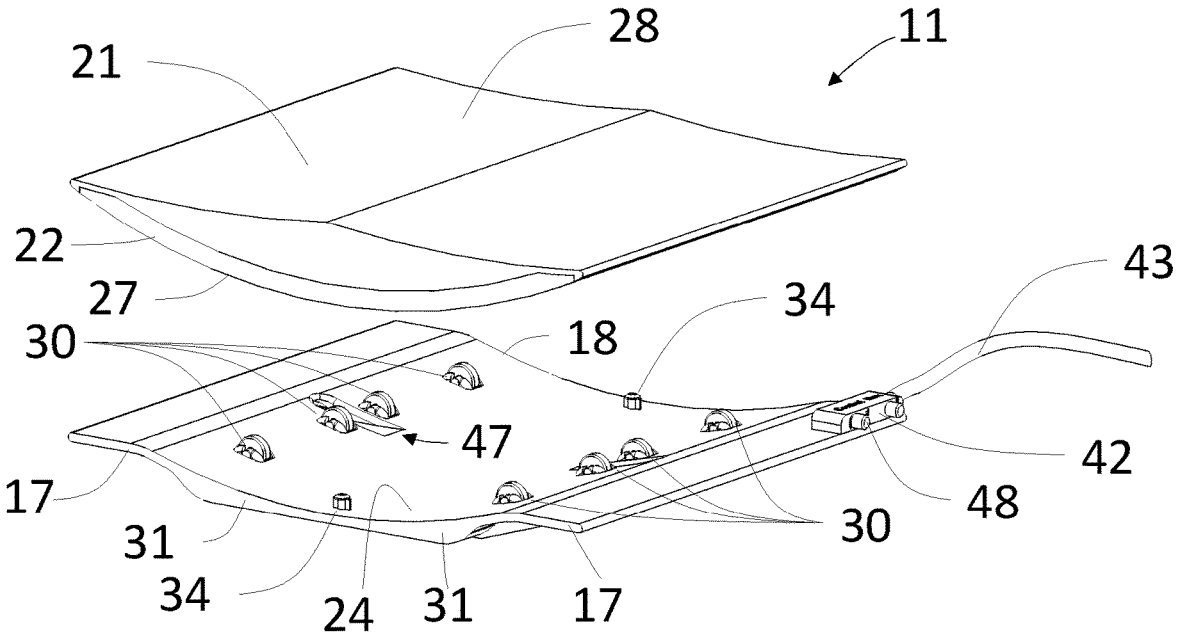

FIG. 6 is a top anterior perspective view of a first alternative embodiment of the lower back exercise apparatus according to the present invention showing an upper seat assembly exploded from a lower base assembly and a fragmentary power cord extending from the lower base assembly.

Figure 7:
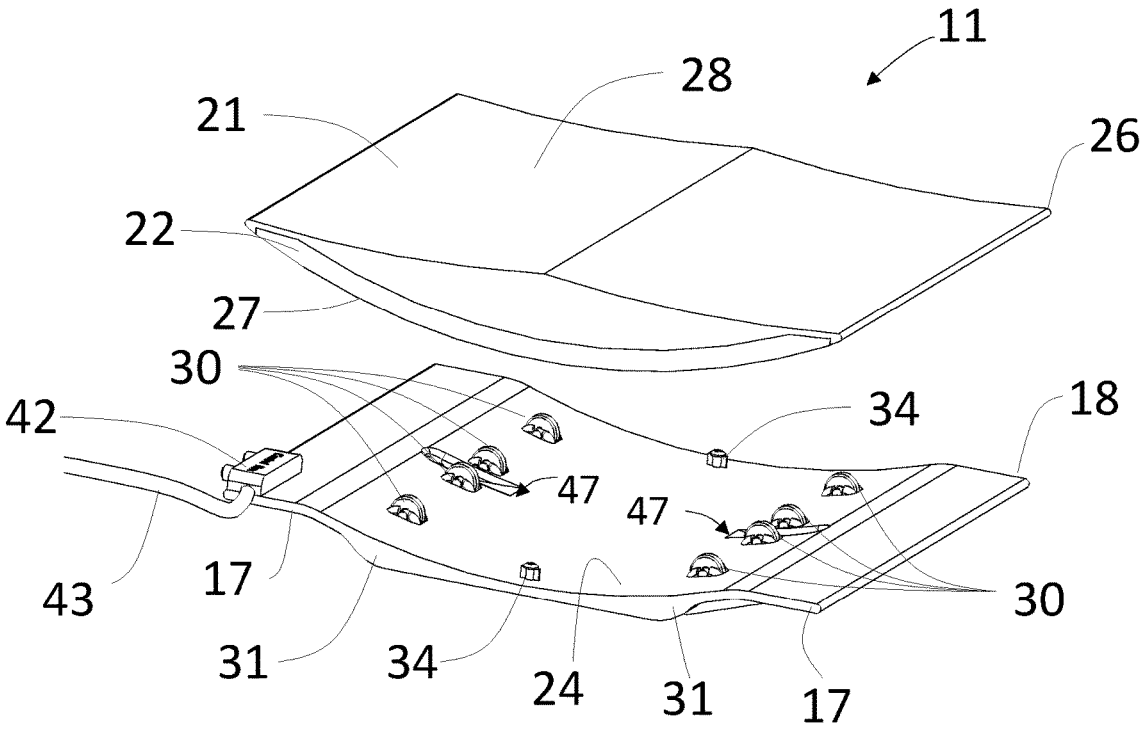

FIG. 7 is a top posterior perspective view of the first alternative embodiment of the lower back exercise apparatus according to the present invention showing the upper seat assembly exploded from the lower base assembly and a fragmentary power cord extending from the lower base assembly.

Figure 8:
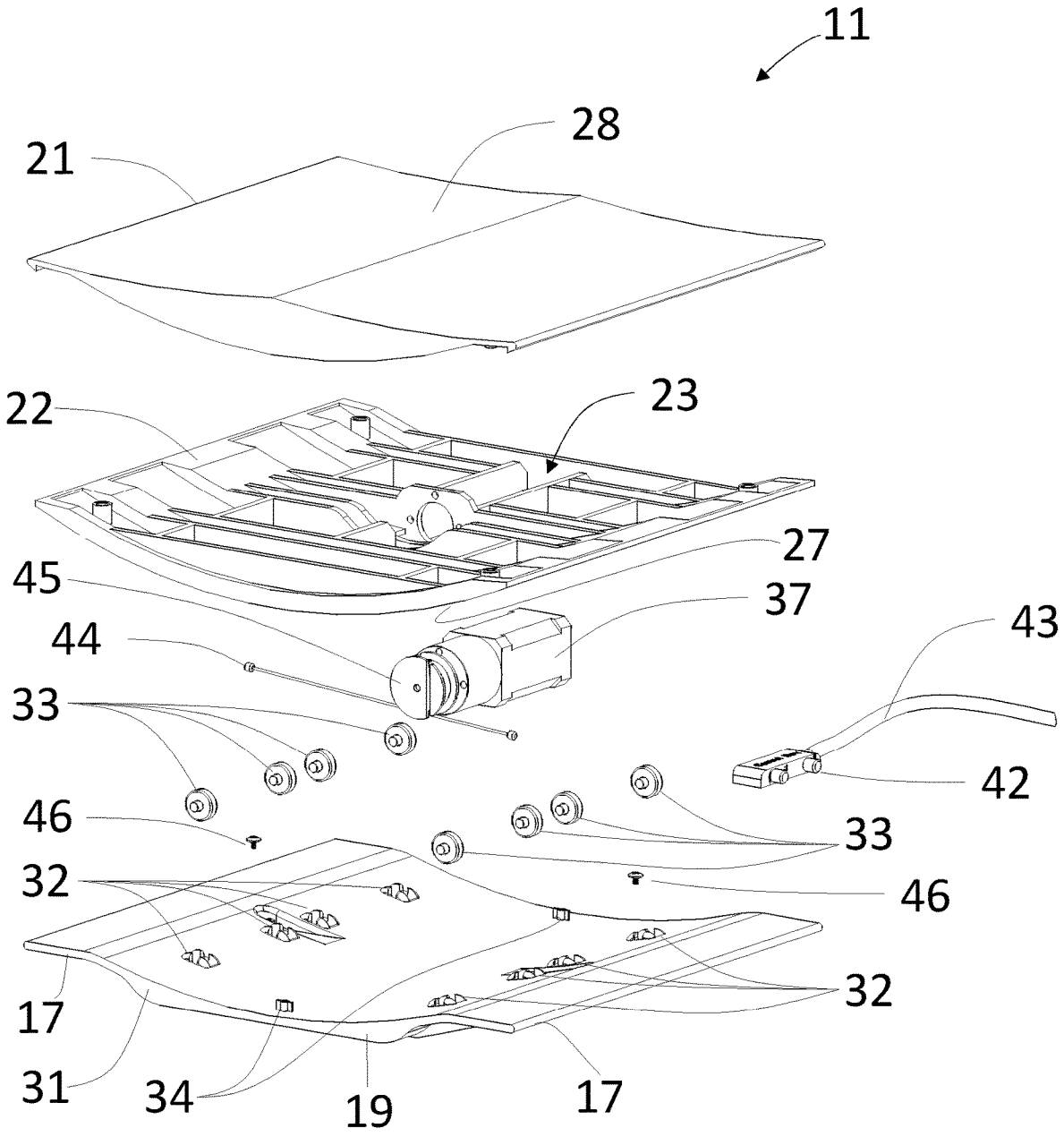

FIG. 8 is a fully exploded top perspective view of the first alternative embodiment of the lower back exercise apparatus according to the present invention showing a fragmentary power cord extending from a control module of the lower base assembly.

Figure 9:
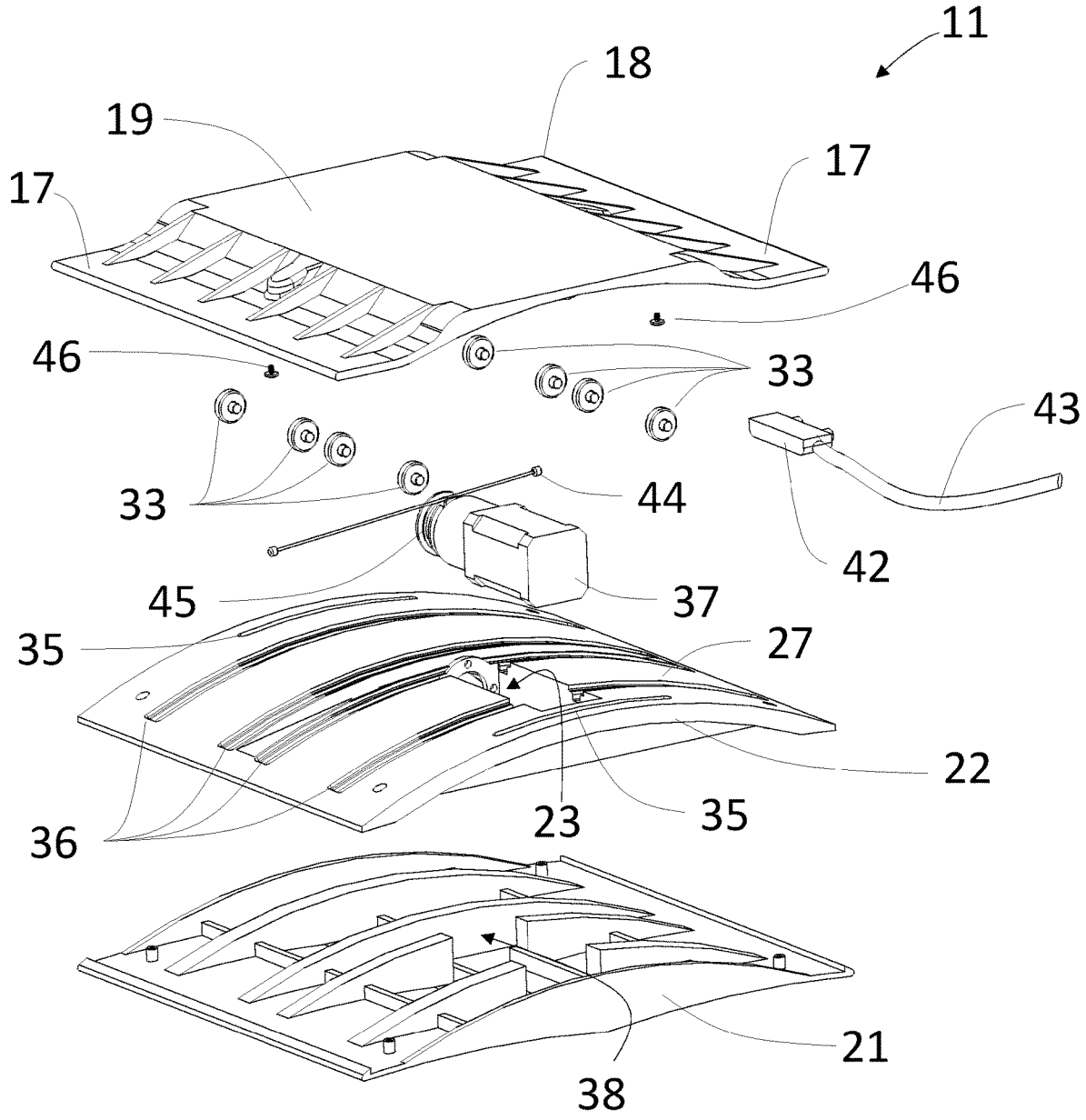

FIG. 9 is a fully exploded bottom perspective view of the first alternative embodiment of the lower back exercise apparatus according to the present invention showing a fragmentary power cord extending from a control module of the lower base assembly.

Figure 10:
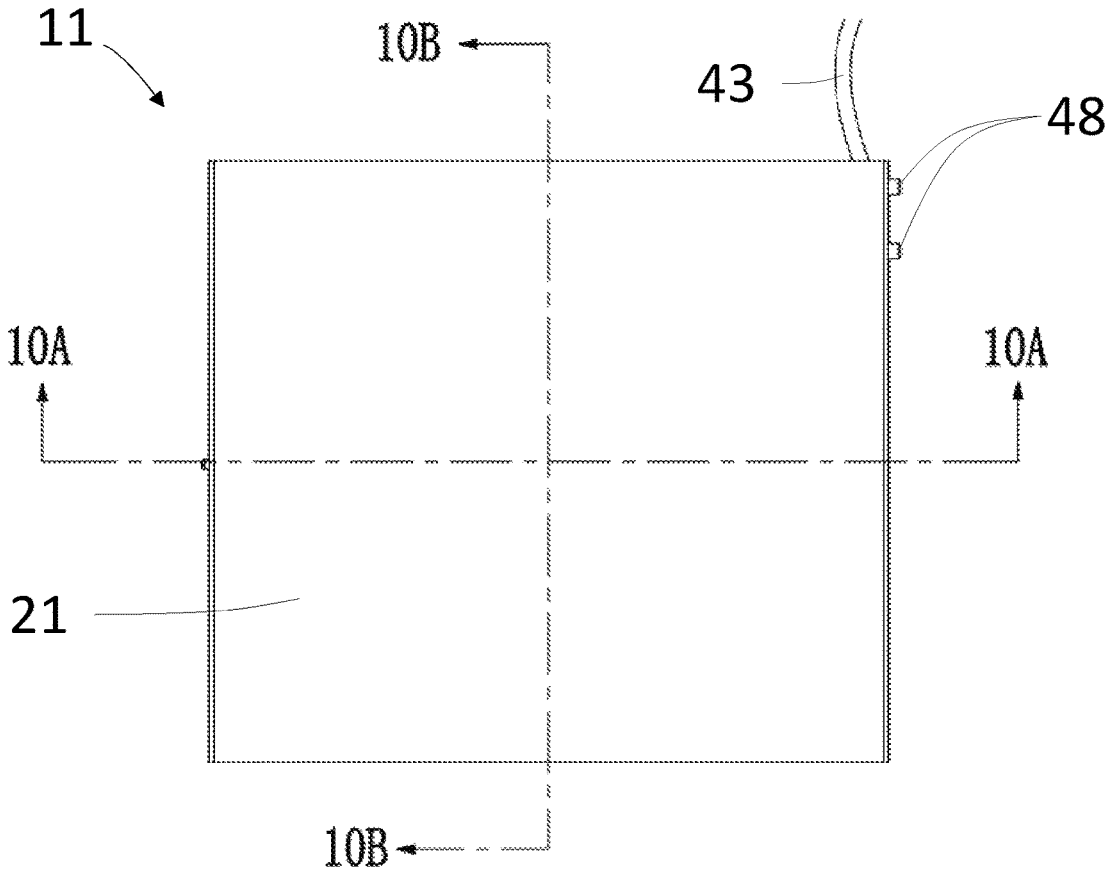

FIG. 10 is a top plan view of the first alternative embodiment of the lower back exercise apparatus according to the present invention showing a fragmentary power cord extending away from the apparatus.

Figure 10A:
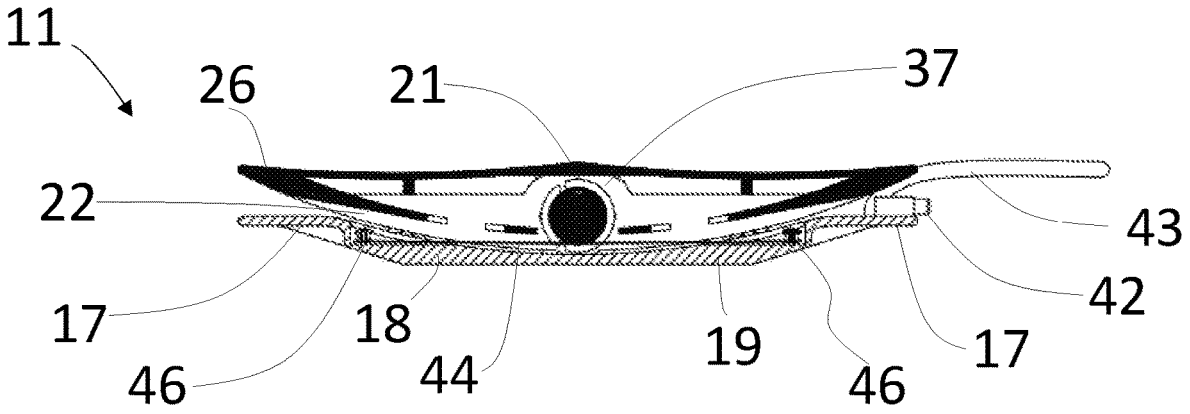

FIG. 10A is a lateral cross-sectional view of the first alternative embodiment of the lower back exercise apparatus according to the present invention as sectioned from FIG. 10.

Figure 10B:
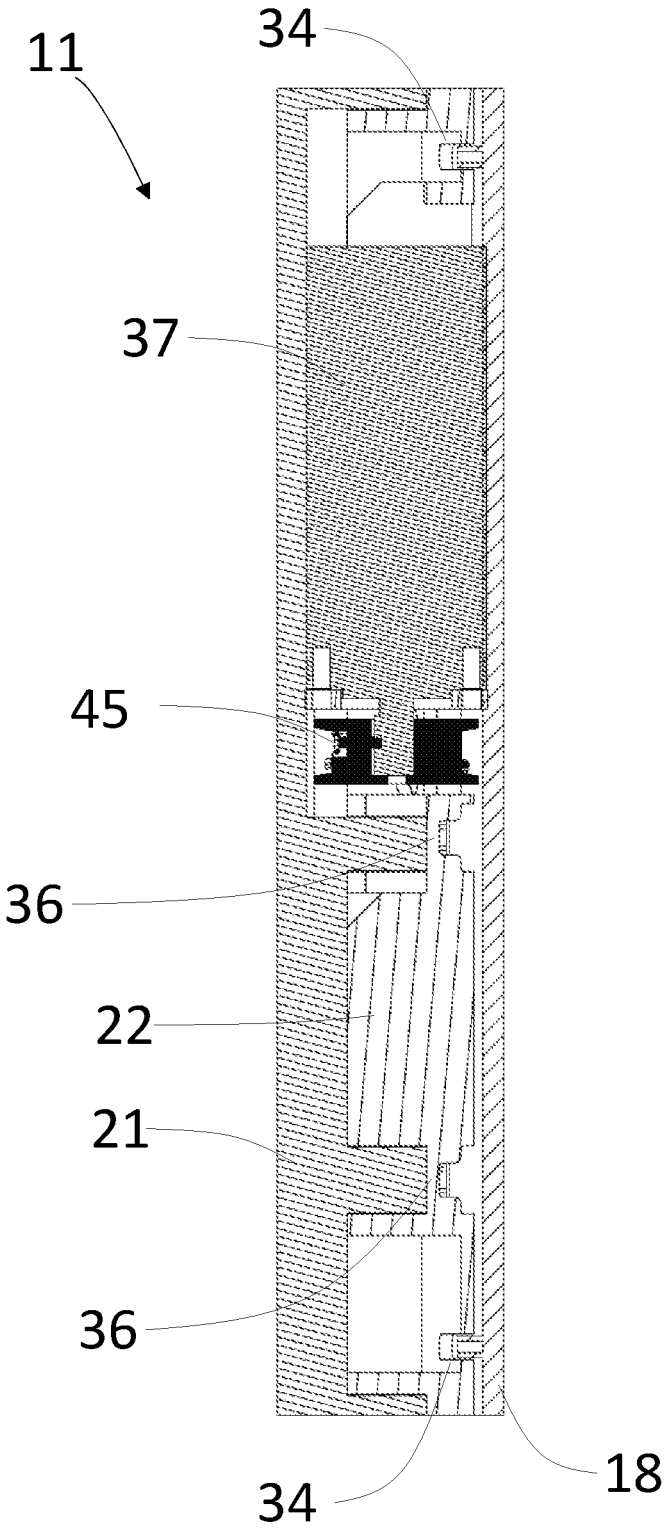

FIG. 10B is an enlarged longitudinal cross-sectional view of the first alternative embodiment of the lower back exercise apparatus according to the present invention as sectioned from FIG. 10.

Figure 11:
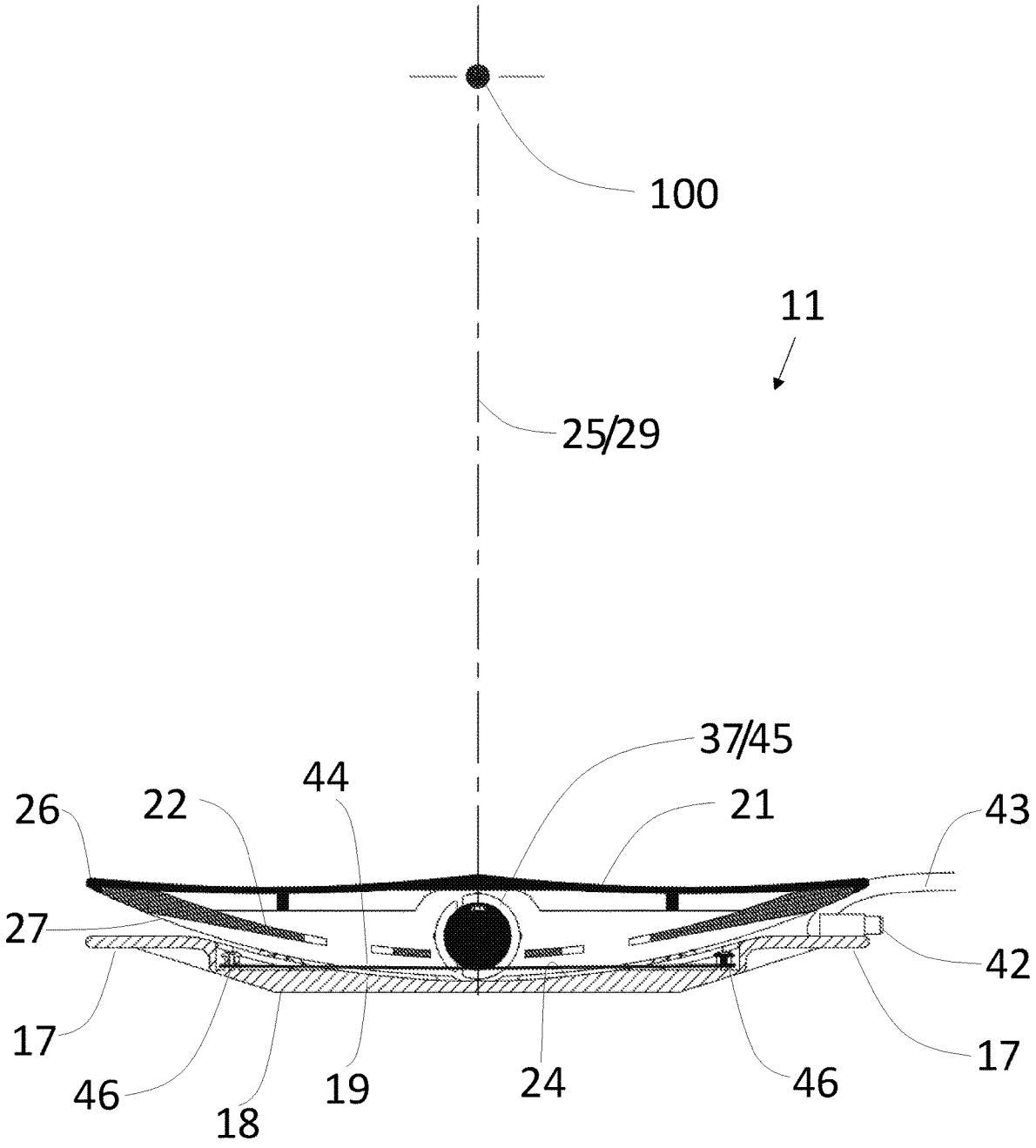
Figure 12:
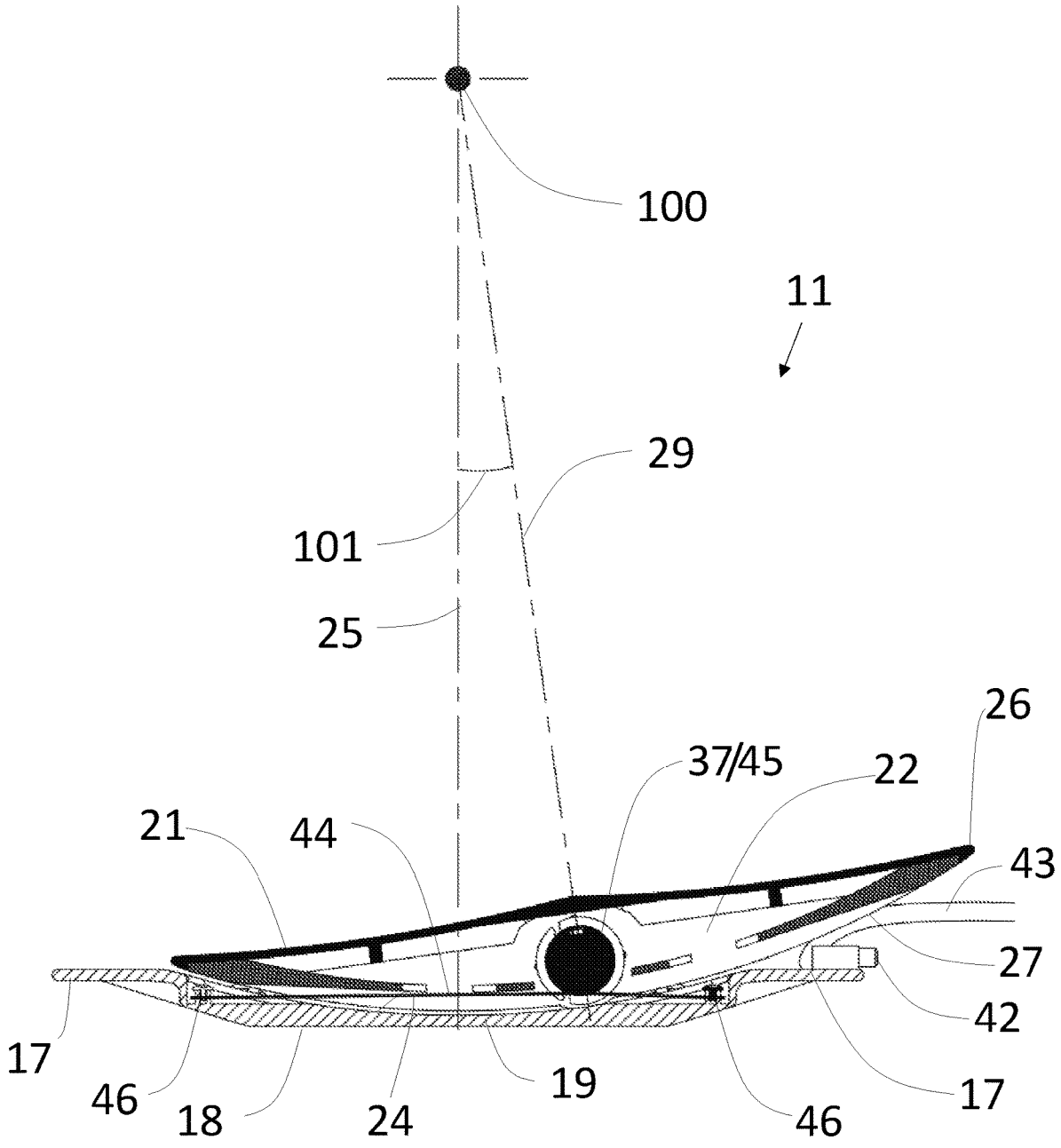
Figure 13:
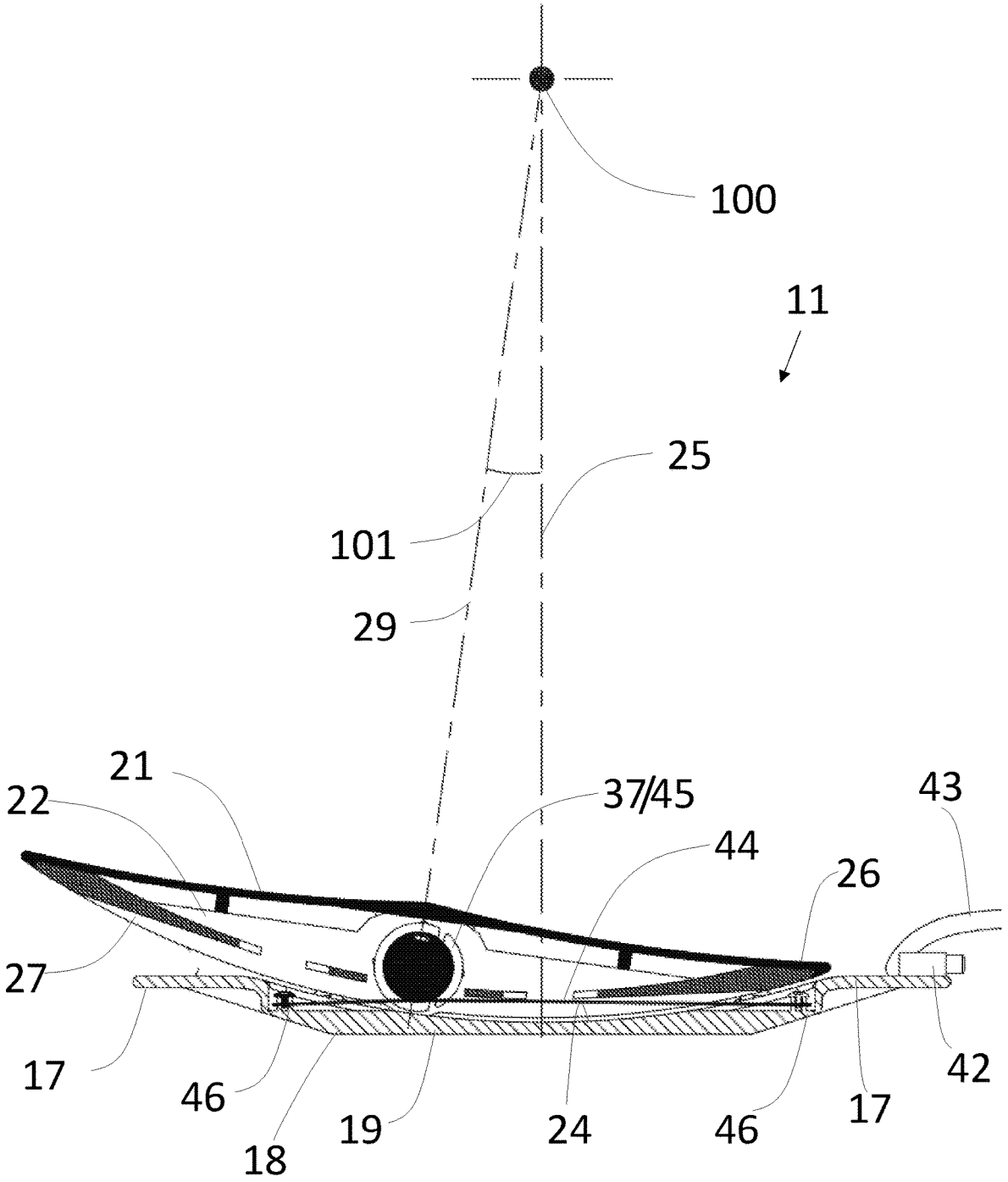

FIG. 11 is a first sequential lateral cross-sectional depiction of the first alternative embodiment of the lower back exercise apparatus according to the present invention showing an upper seat assembly in a central equilibrium position relative to a lower base assembly, the upper seat assembly being movable relative to the lower base assembly in a pendulum swing type motion as generally and comparatively further depicted in FIGS. 12 and 13.

FIG. 12 is a second sequential lateral cross-sectional depiction of the first alternative embodiment of the lower back exercise apparatus according to the present invention showing the upper seat assembly in a maximum right arc position relative to the lower base assembly, the upper seat assembly being movable relative to the lower base assembly in a pendulum swing type motion as generally and comparatively further depicted in FIGS. 11 and 13.

FIG. 13 is a third sequential diagrammatic depiction of the first alternative embodiment of the lower back exercise apparatus according to the present invention showing the upper seat assembly in a maximum left arc position relative to the lower base assembly, the upper seat assembly being movable relative to the lower base assembly in a pendulum swing type motion as generally and comparatively further depicted in FIGS. 11 and 12.

Figure 14:
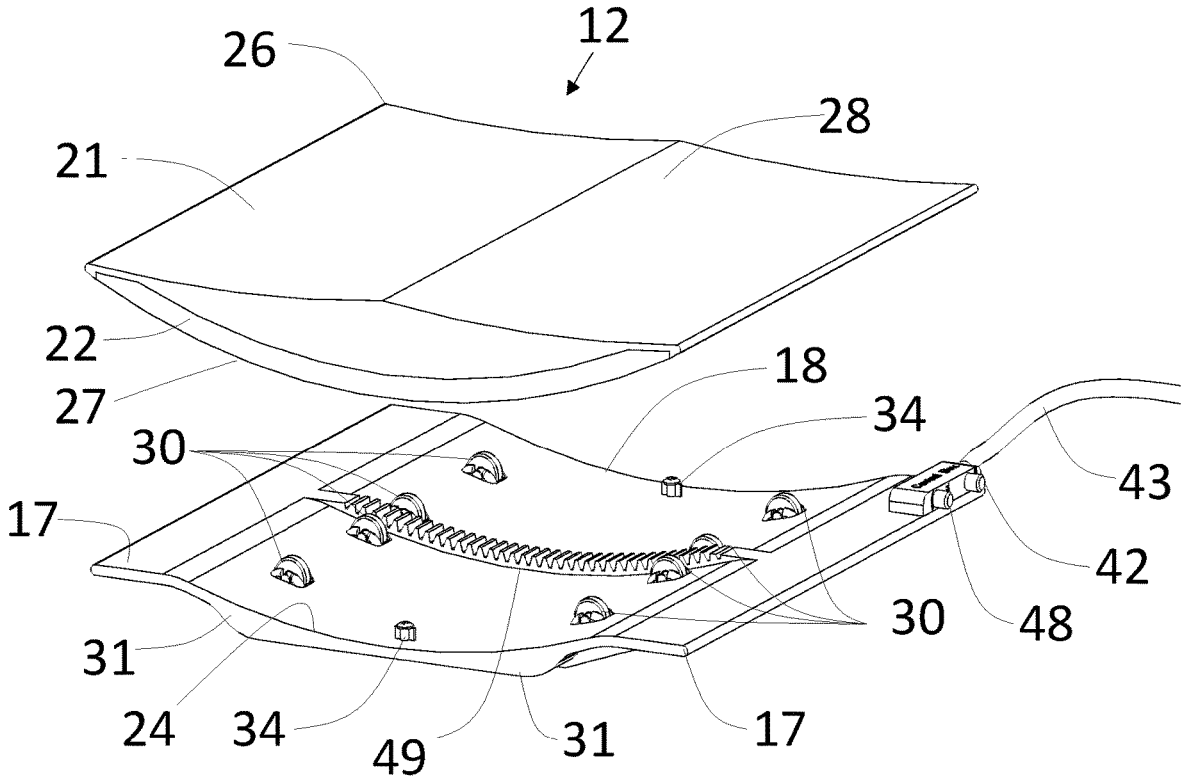

FIG. 14 is a top anterior perspective view of a second alternative embodiment of the lower back exercise apparatus according to the present invention showing an upper seat assembly exploded from a lower base assembly and a fragmentary power cord extending from the lower base assembly.

Figure 15:
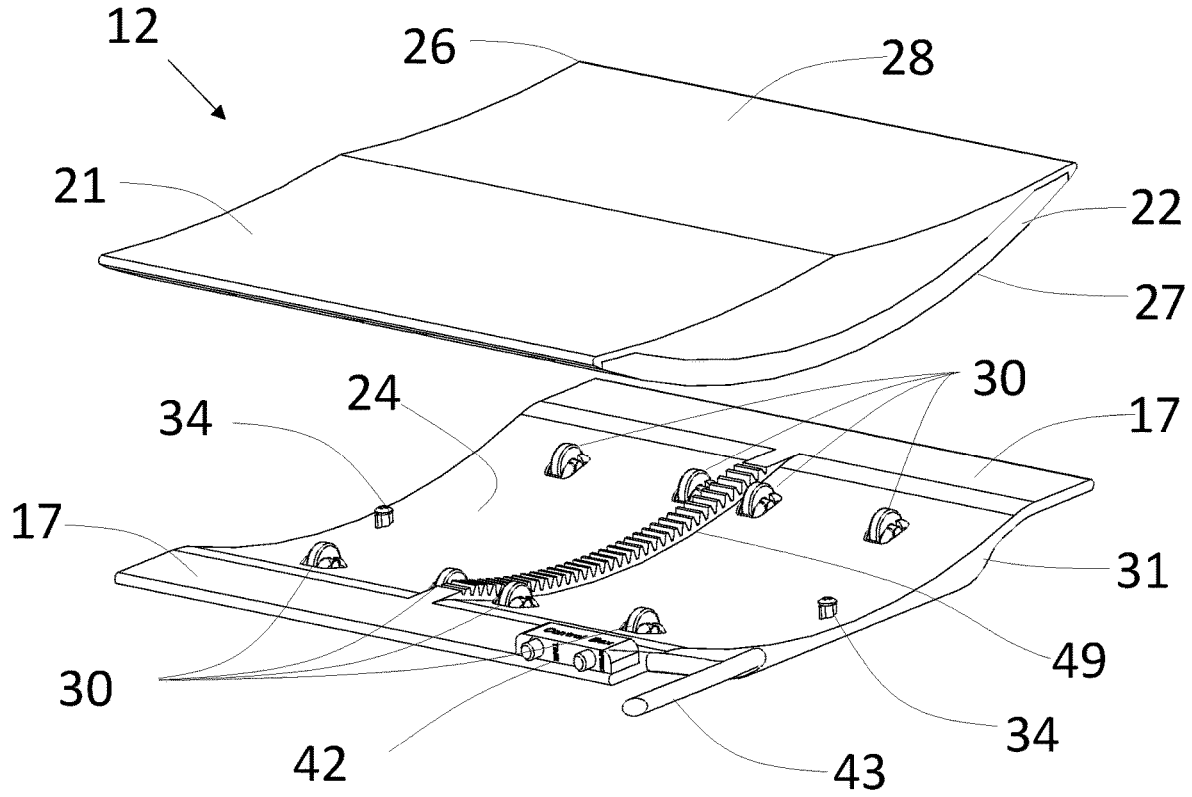

FIG. 15 is a top posterior perspective view of the second alternative embodiment of the lower back exercise apparatus according to the present invention showing the upper seat assembly exploded from the lower base assembly and a fragmentary power cord extending from the lower base assembly.

Figure 16:
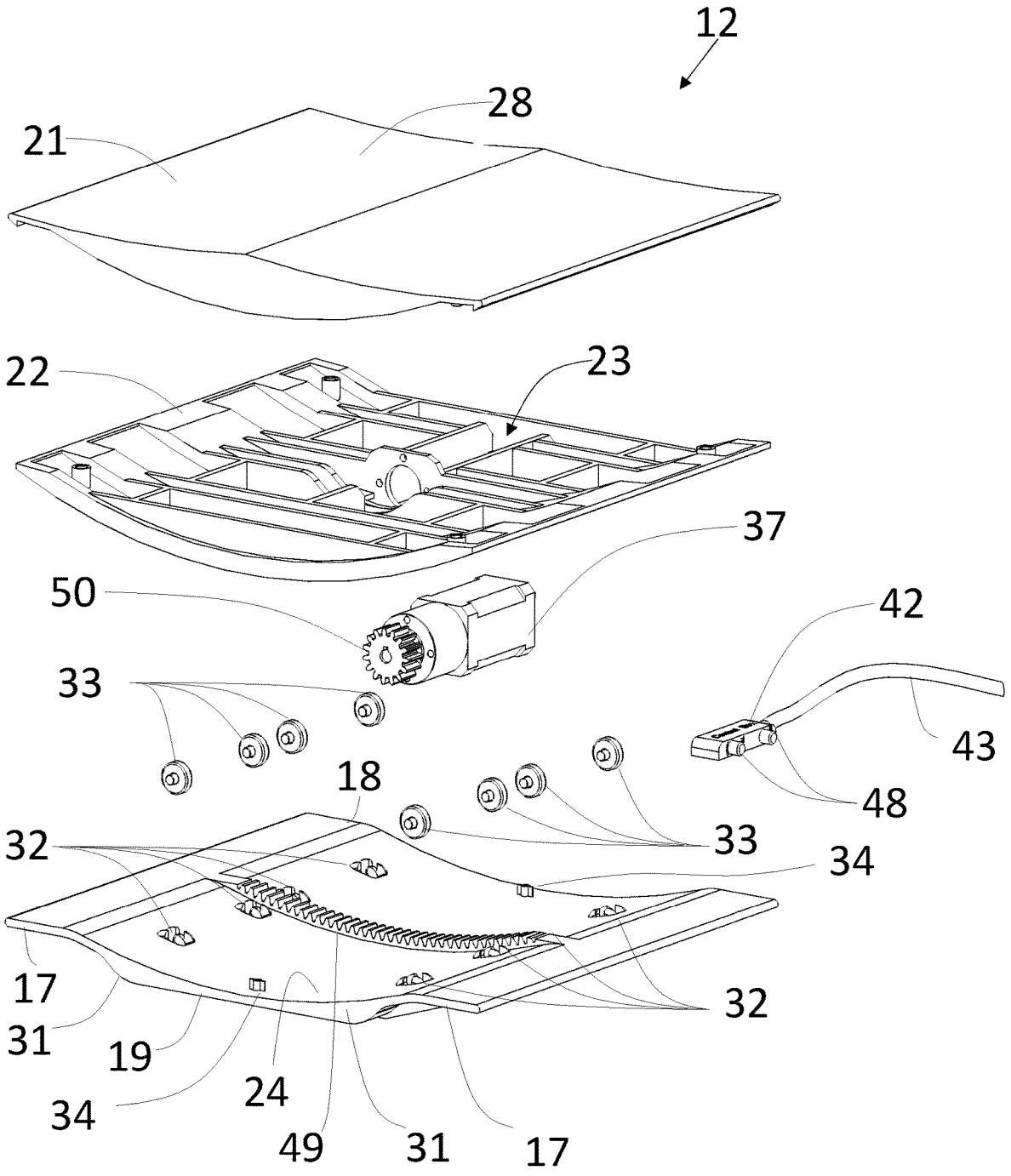

FIG. 16 is a fully exploded top perspective view of the second alternative embodiment of the lower back exercise apparatus according to the present invention showing a fragmentary power cord extending from a control module of the lower base assembly.

Figure 17:
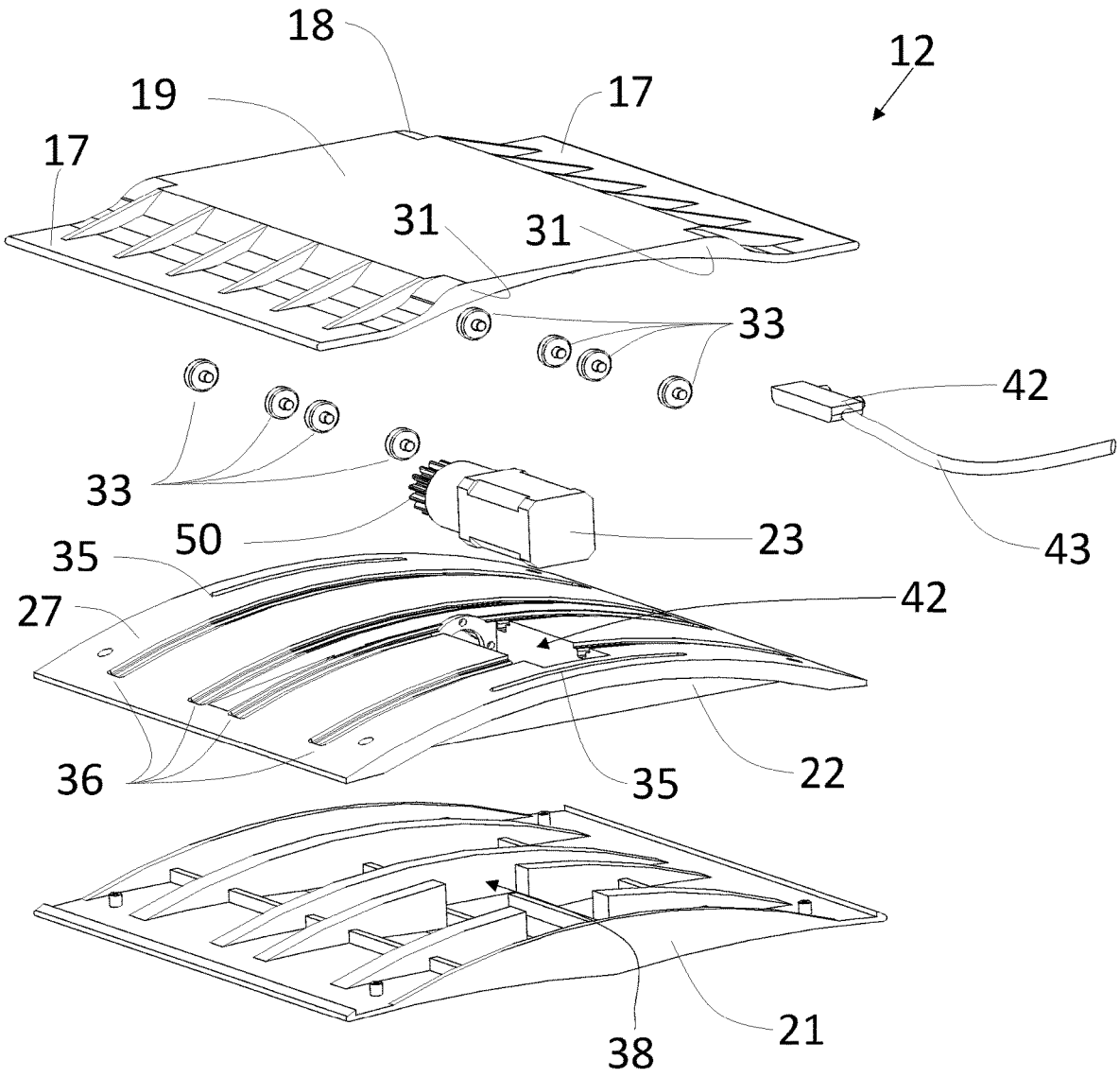

FIG. 17 is a fully exploded bottom perspective view of the second alternative embodiment of the lower back exercise apparatus according to the present invention showing a fragmentary power cord extending from a control module of the lower base assembly.

Figure 18:
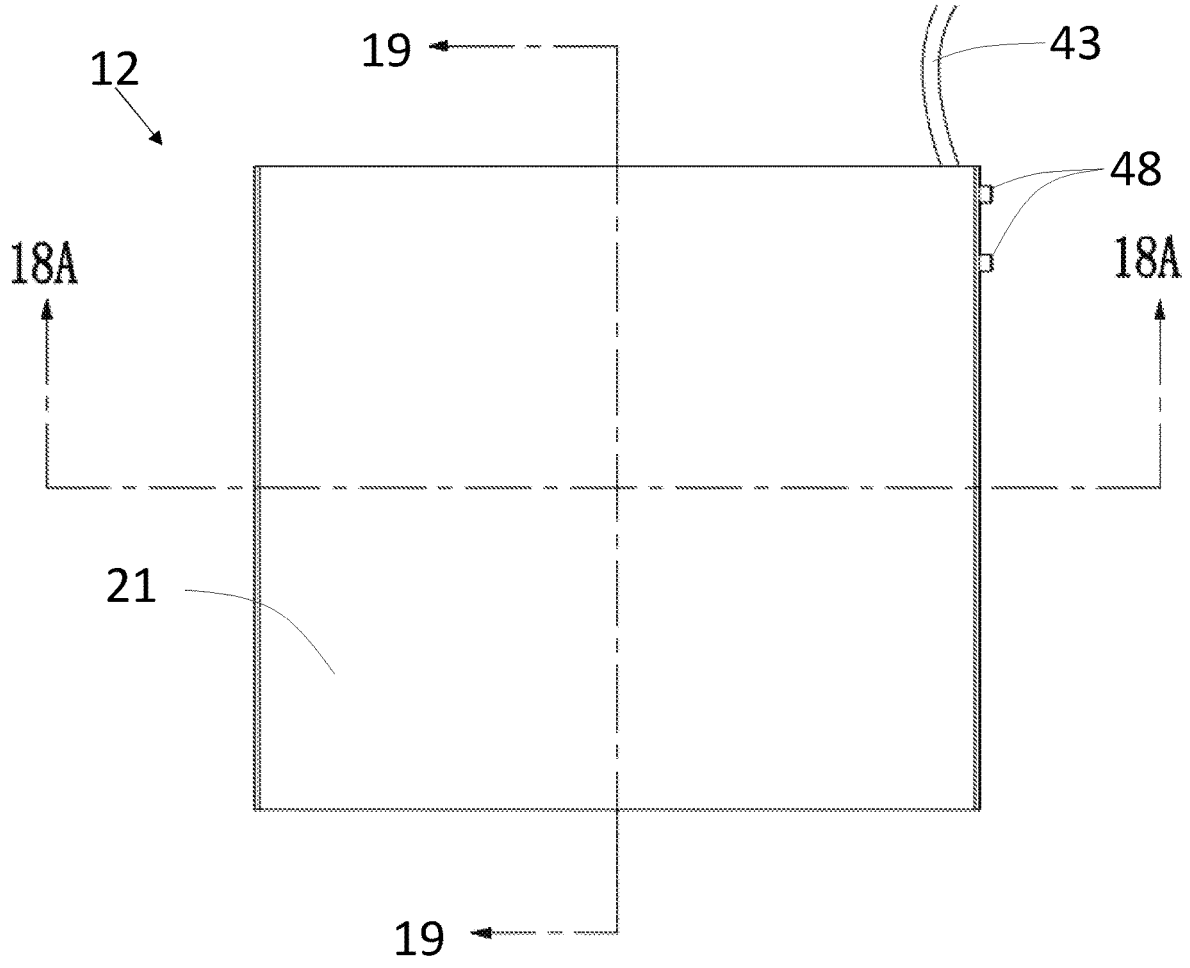

FIG. 18 is a top plan view of the lower seat assembly of the second alternative embodiment of the lower back exercise apparatus according to the present invention showing a fragmentary power cord extending away from the apparatus.

Figure 18A:
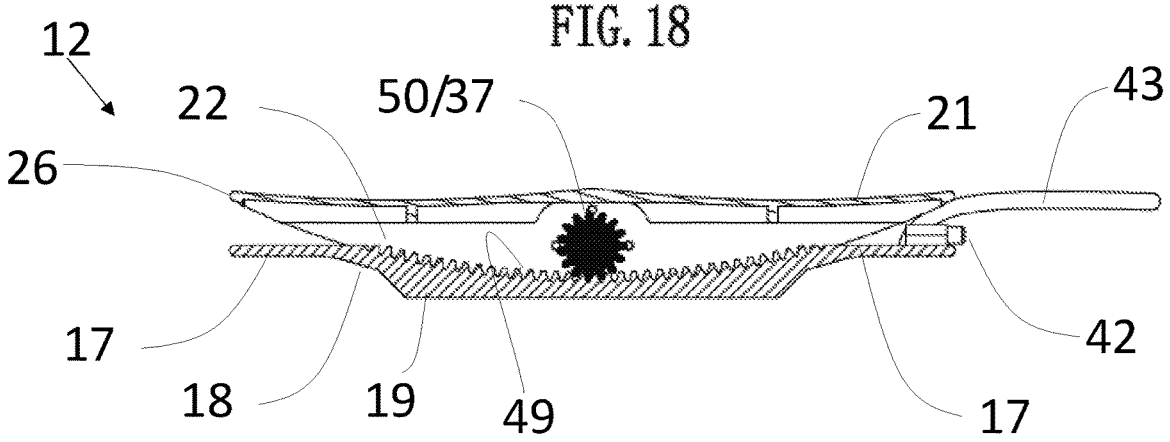

FIG. 18A is a lateral cross-sectional view of the second alternative embodiment of the lower back exercise apparatus according to the present invention as sectioned from FIG. 18.

Figure 19:
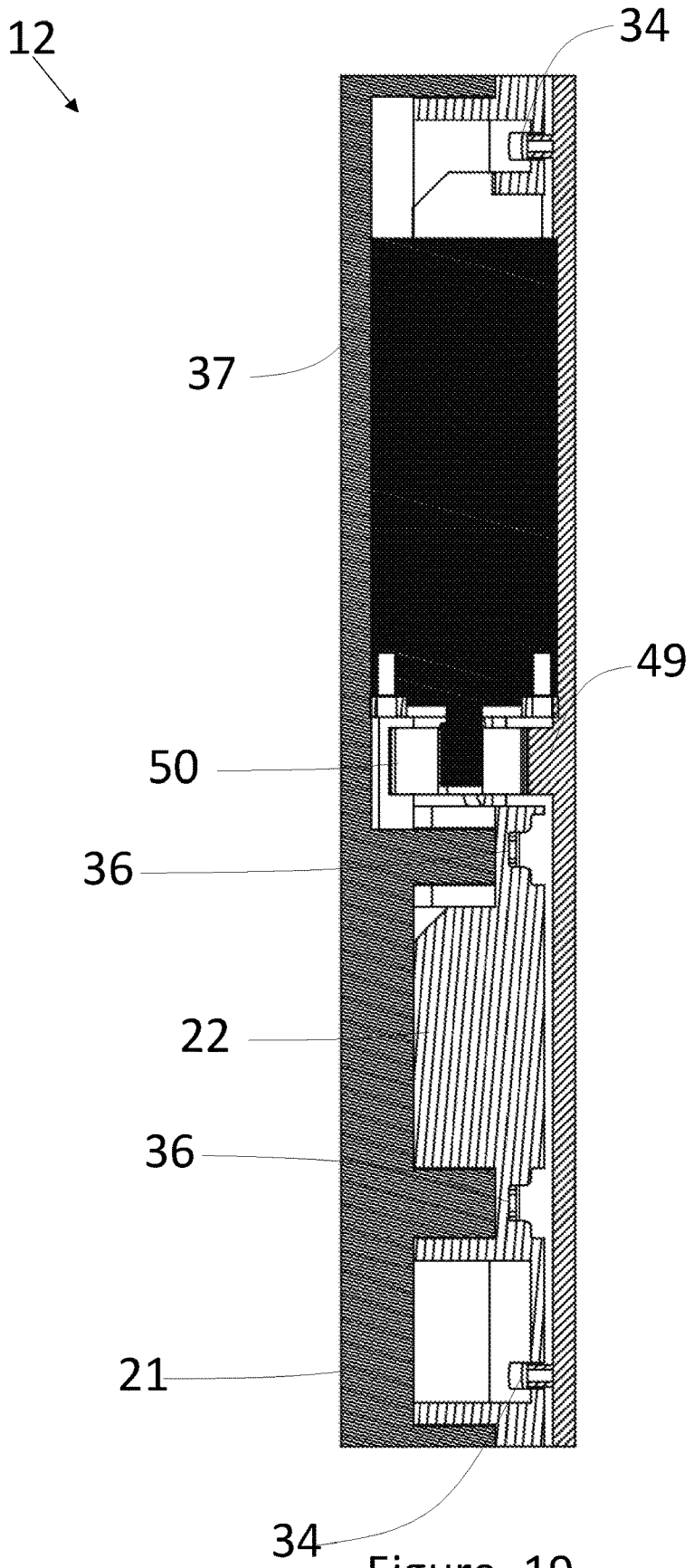

FIG. 19 is an enlarged longitudinal cross-sectional view of the second alternative embodiment of the lower back exercise apparatus according to the present invention as sectioned from FIG. 18.

Figure 20:
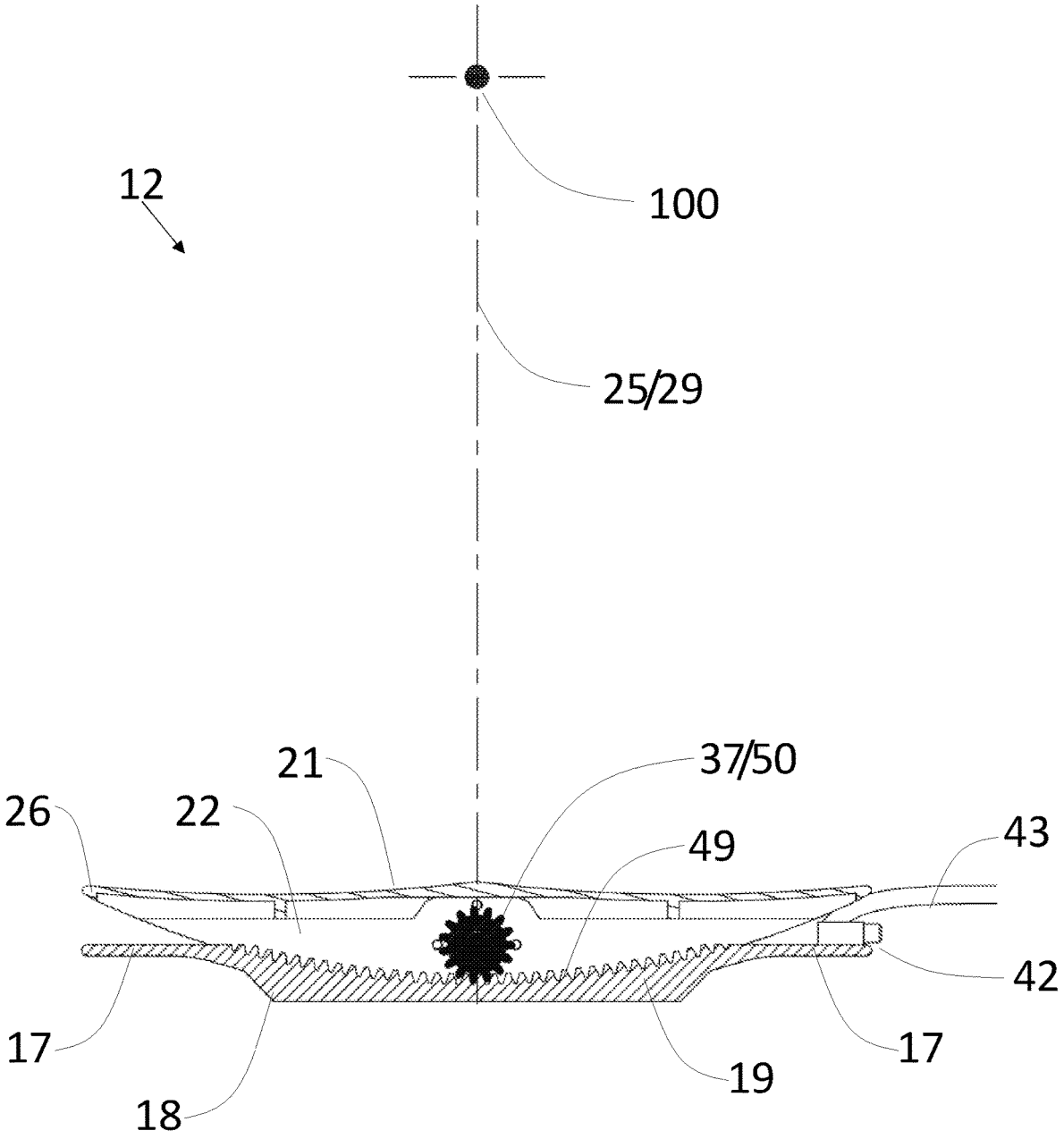
Figure 21:
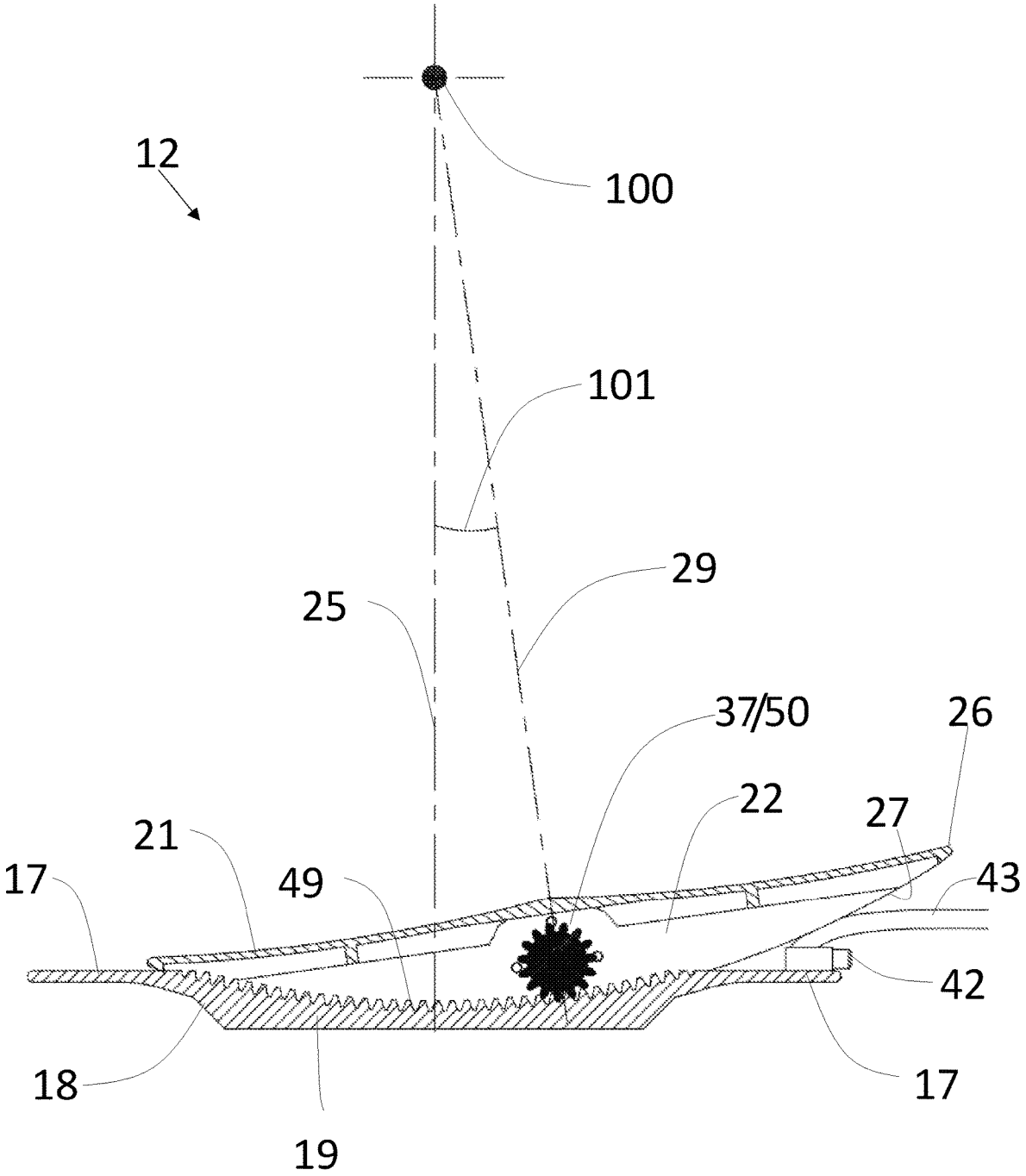
Figure 22:
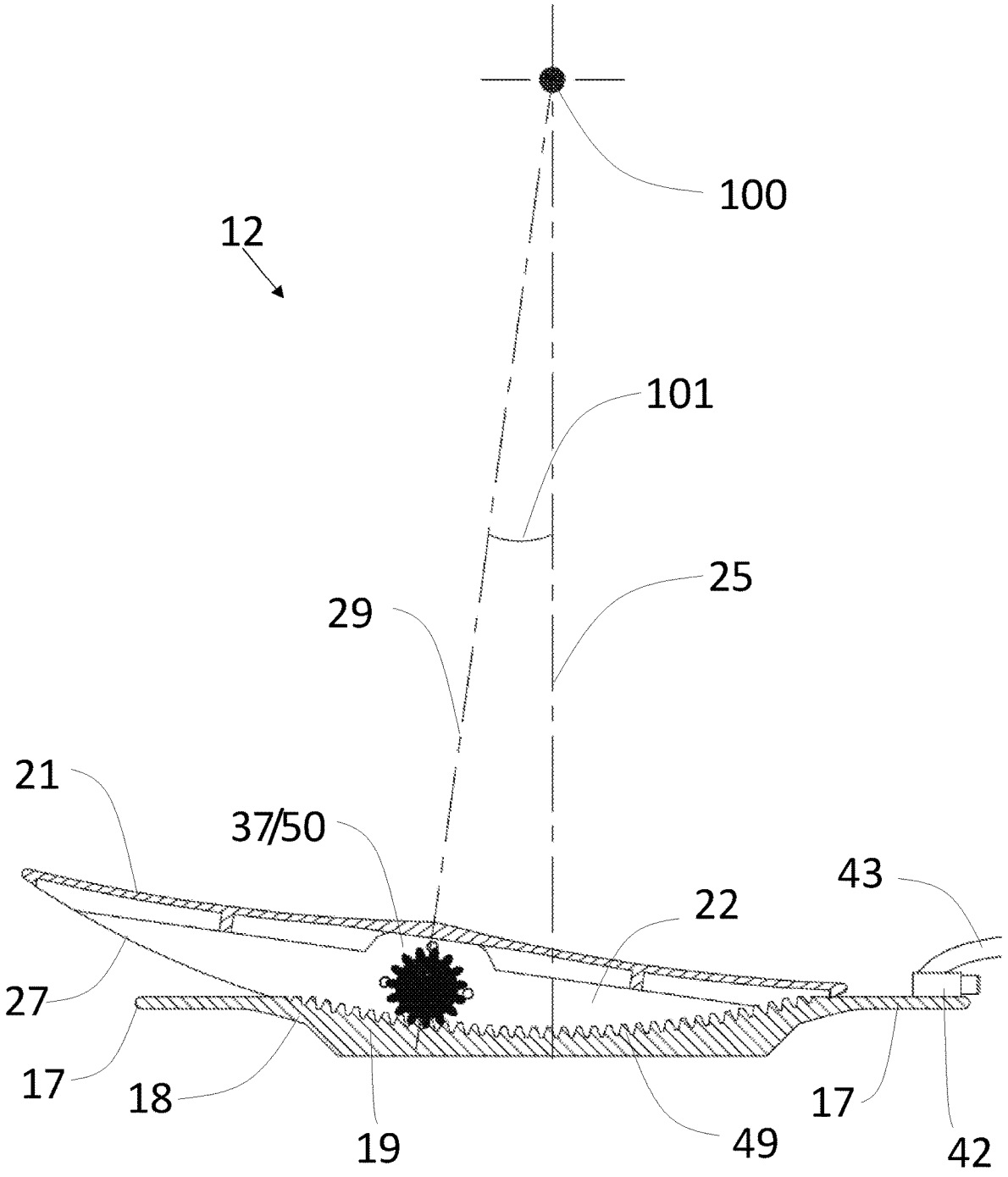

FIG. 20 is a first sequential lateral cross-sectional depiction of the second alternative embodiment of the lower back exercise apparatus according to the present invention showing an upper seat assembly in a central equilibrium position relative to a lower base assembly, the upper seat assembly being movable relative to the lower base assembly in a pendulum swing type motion as generally and comparatively further depicted in FIGS. 21 and 22.

FIG. 21 is a second sequential lateral cross-sectional depiction of the second alternative embodiment of the lower back exercise apparatus according to the present invention showing the upper seat assembly in a maximum right arc position relative to the lower base assembly, the upper seat assembly being movable relative to the lower base assembly in a pendulum swing type motion as generally and comparatively further depicted in FIGS. 20 and 22.

FIG. 22 is a third sequential diagrammatic depiction of the second alternative embodiment of the lower back exercise apparatus according to the present invention showing the upper seat assembly in a maximum left arc position relative to the lower base assembly, the upper seat assembly being movable relative to the lower base assembly in a pendulum swing type motion as generally and comparatively further depicted in FIGS. 20 and 21.

Figure 23:
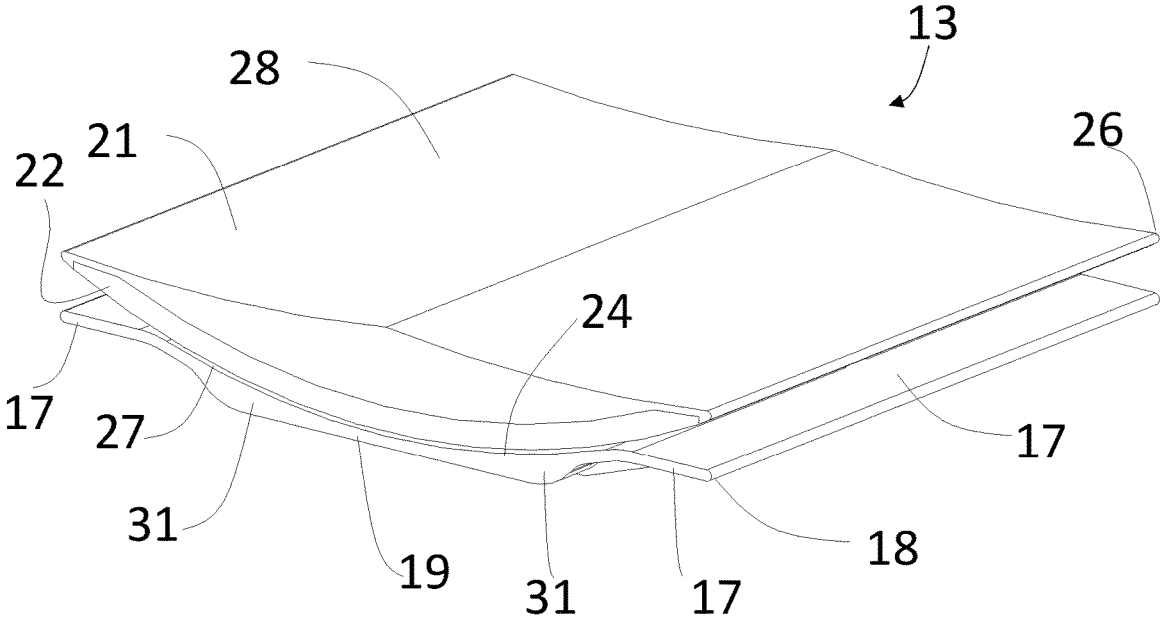

FIG. 23 is a top anterior perspective view of a third alternative (manual) embodiment of the lower back exercise apparatus according to the present invention.

Figure 24:
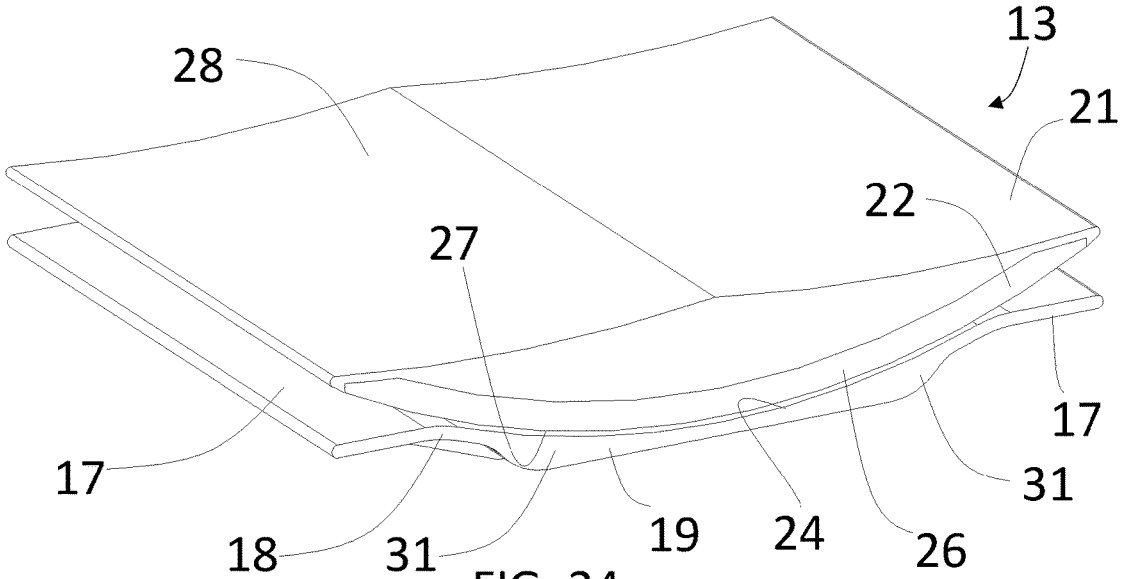

FIG. 24 is a top posterior perspective view of the third alternative (manual) embodiment of the lower back exercise apparatus according to the present invention.

Figure 25:
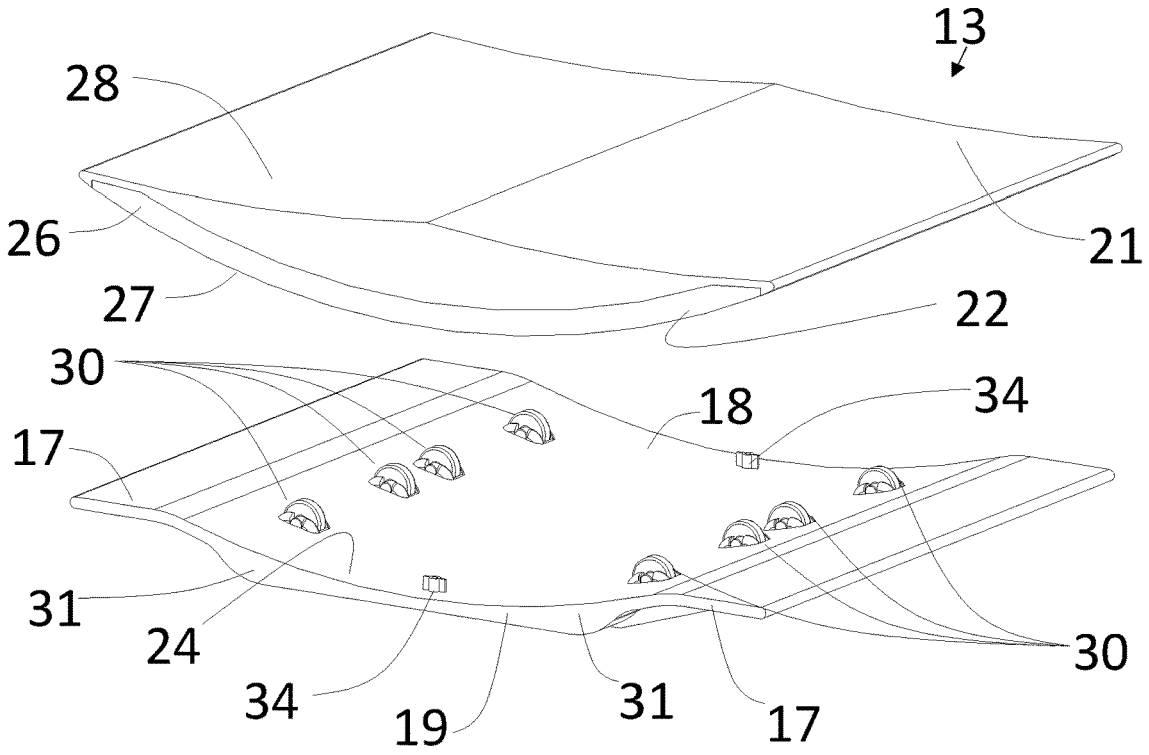

FIG. 25 is a top anterior perspective view of the alternative embodiment of the lower back exercise apparatus according to the present invention showing an upper seat assembly exploded from a lower base assembly.

Figure 26:
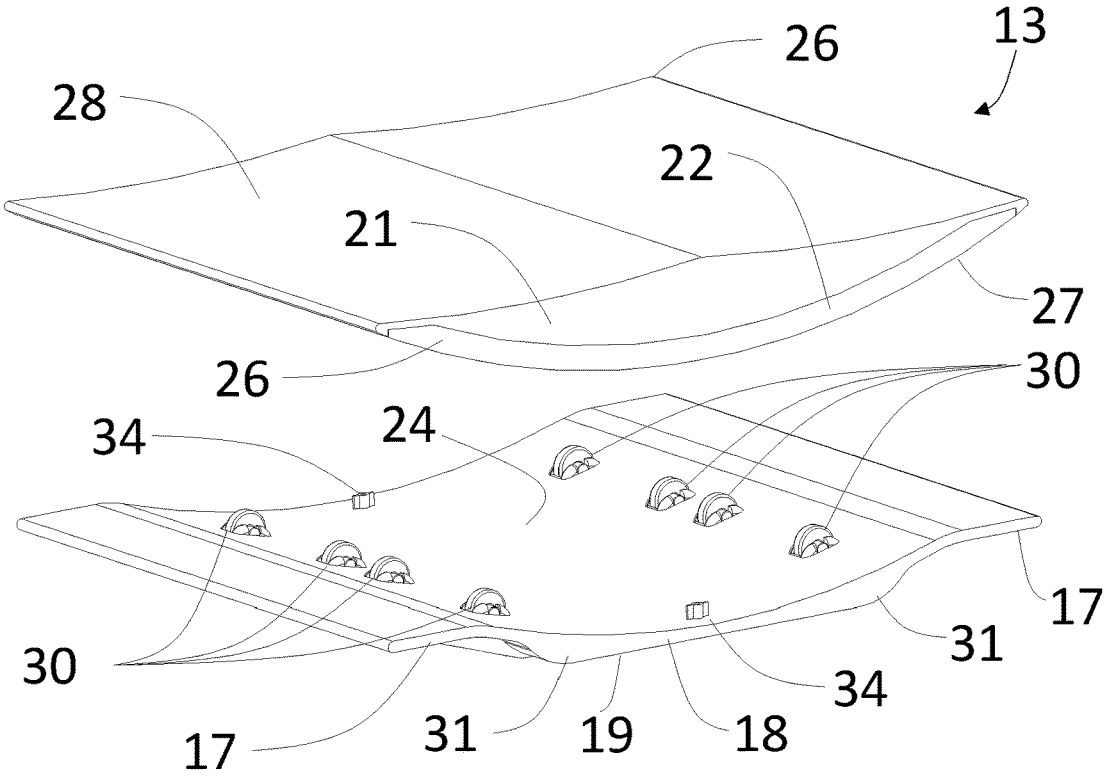

FIG. 26 is a top posterior perspective view of the third alternative embodiment of the lower back exercise apparatus according to the present invention showing the upper seat assembly exploded from the lower base assembly.

Figure 27:
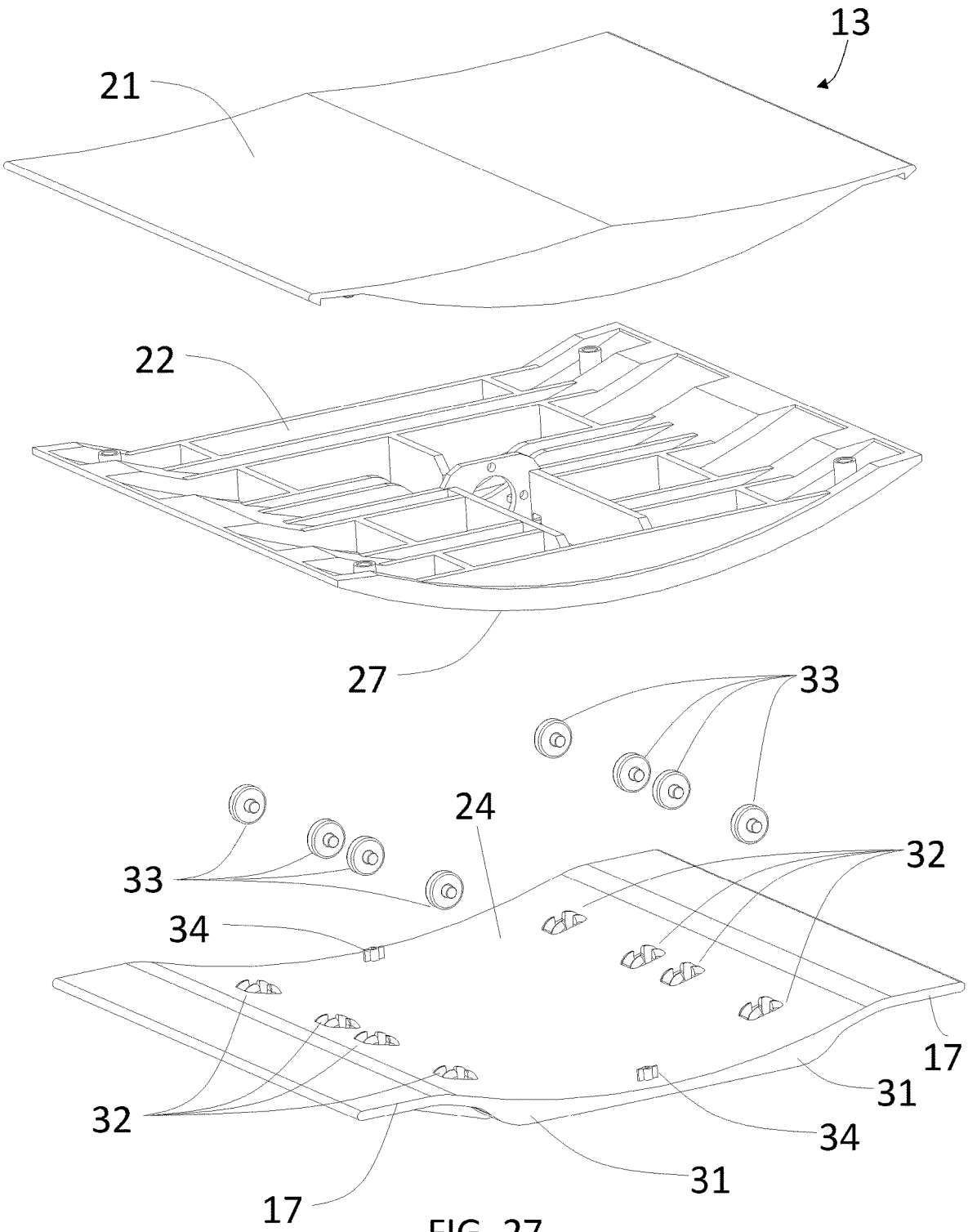

FIG. 27 is a fully exploded top perspective view of the third alternative embodiment of the lower back exercise apparatus according to the present invention.

Figure 28:
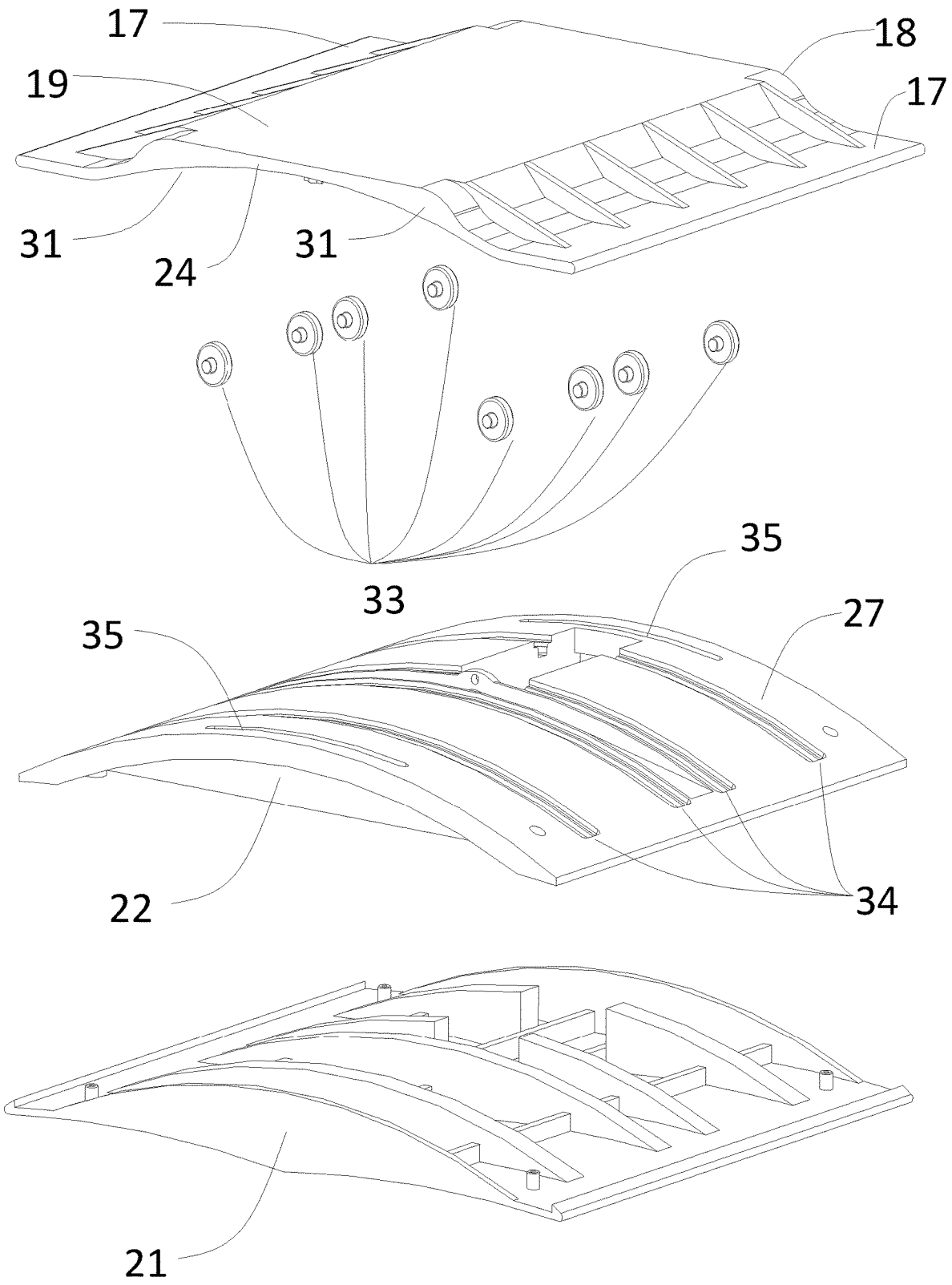

FIG. 28 is a fully exploded bottom perspective view of the third alternative embodiment of the lower back exercise apparatus according to the present invention.

Figure 29:
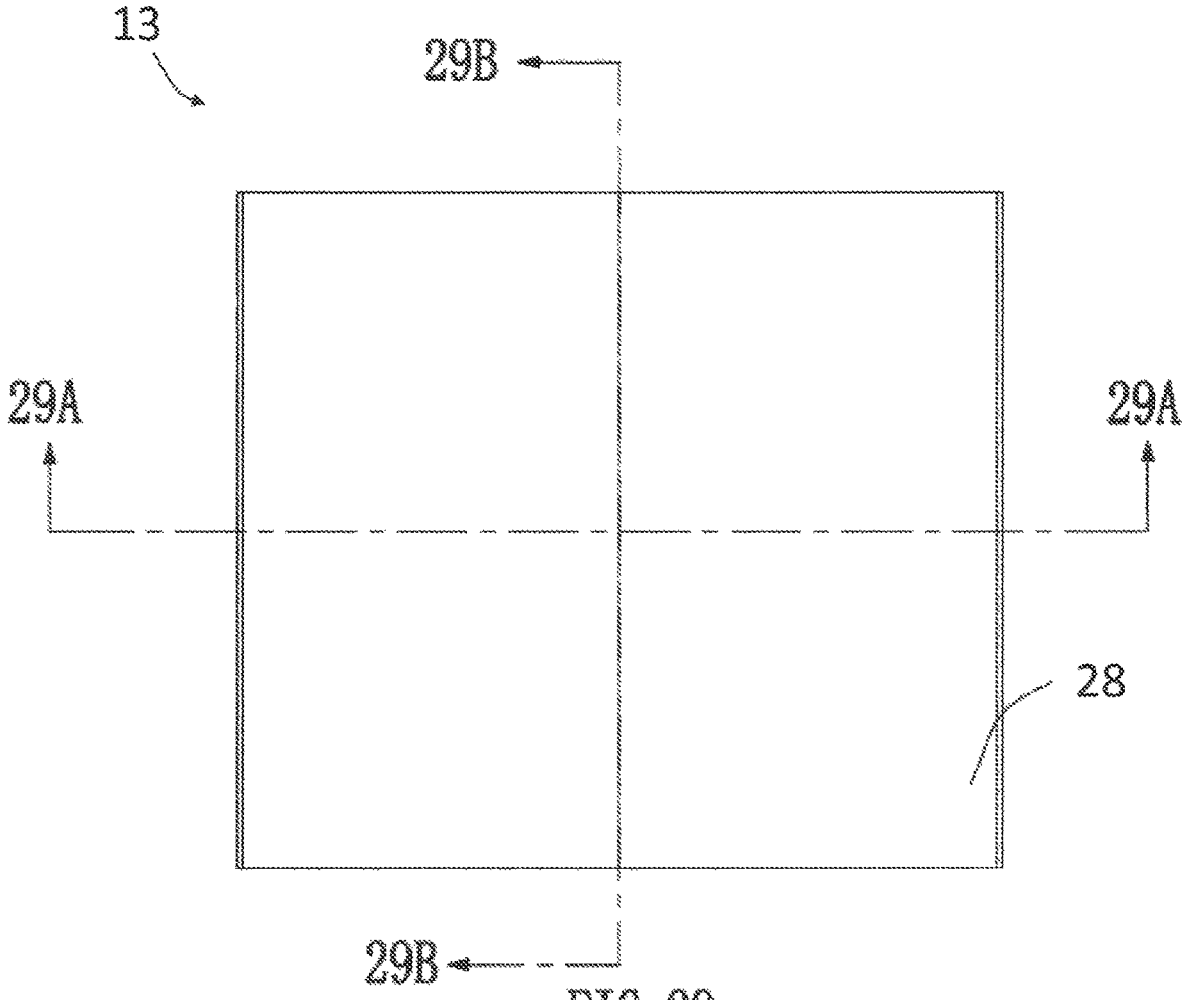

FIG. 29 is a top plan view of the third alternative embodiment of the lower back exercise apparatus according to the present invention.

Figure 29A:
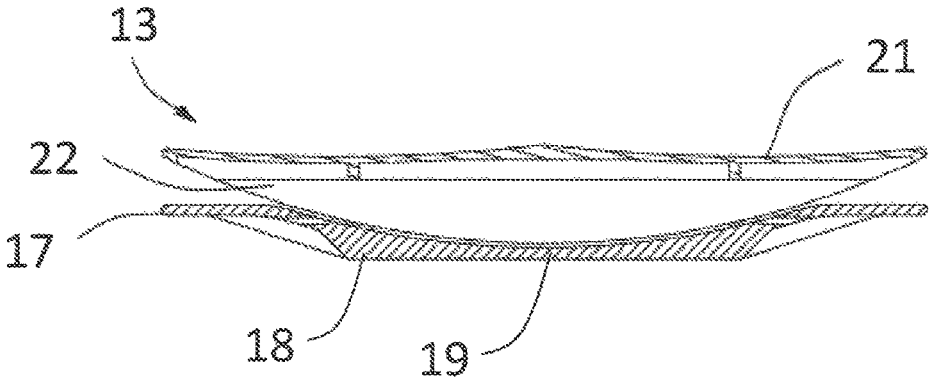

FIG. 29A is a lateral cross-sectional view of the third alternative embodiment of the lower back exercise apparatus according to the present invention as sectioned from FIG. 29.

Figure 29B:
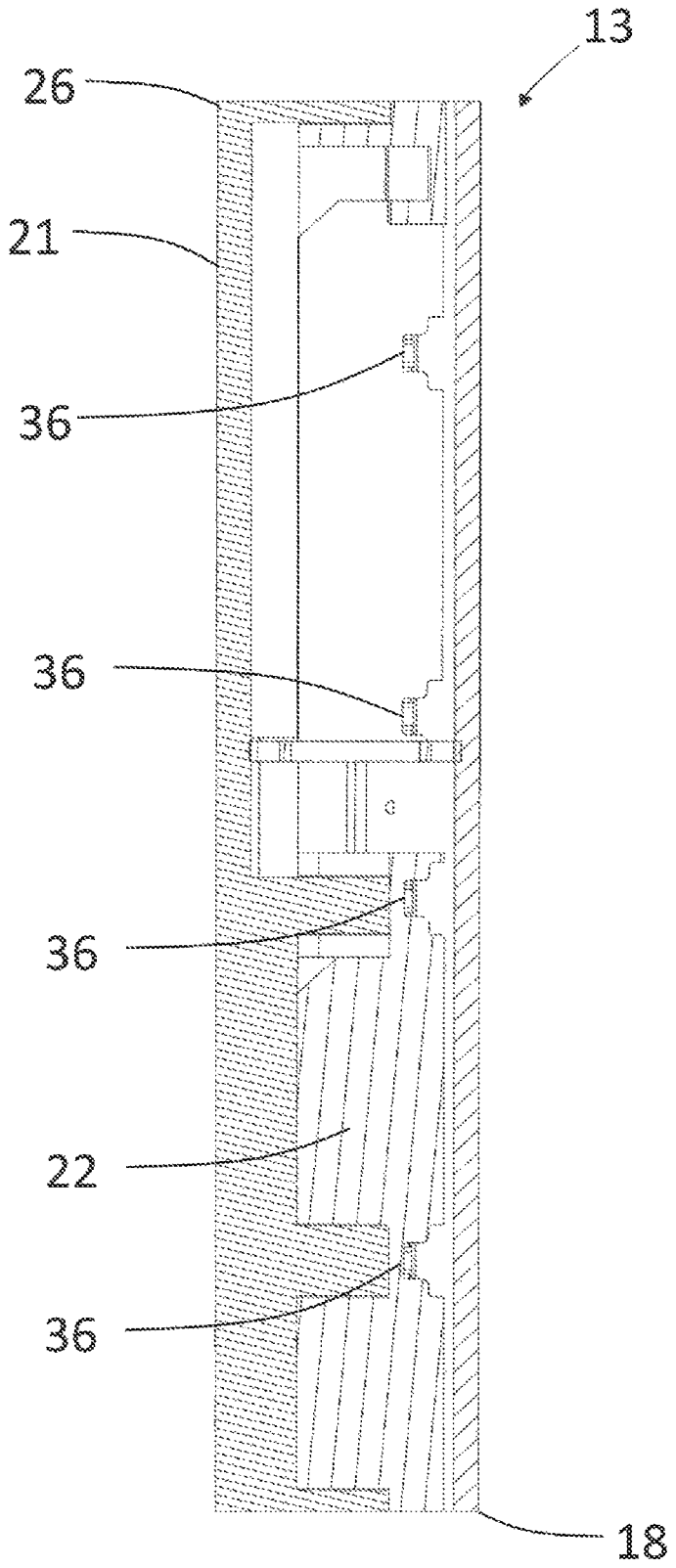

FIG. 29B is an enlarged longitudinal cross-sectional view of the third alternative embodiment of the lower back exercise apparatus according to the present invention as sectioned from FIG. 29.

Figure 30:
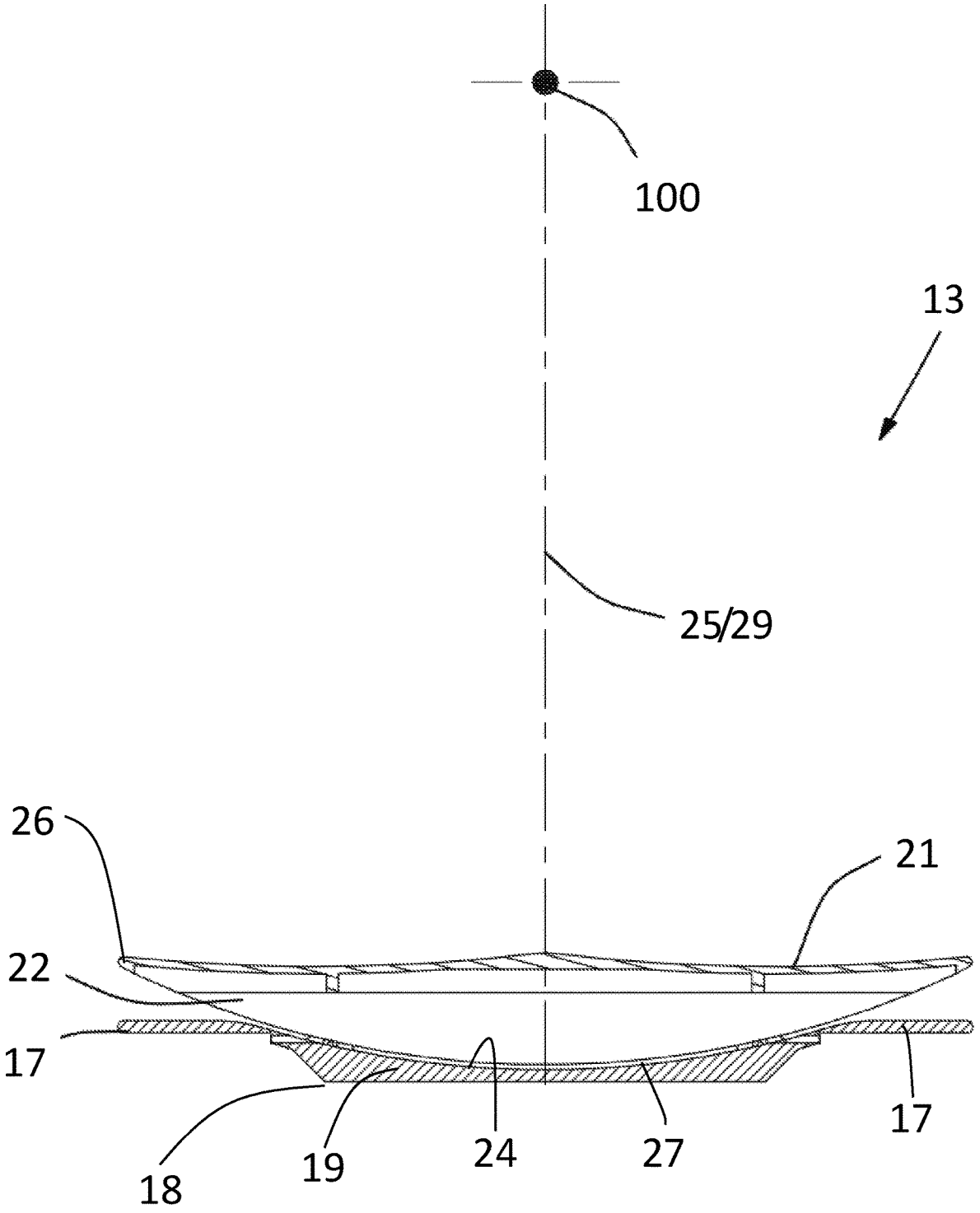
Figure 31:
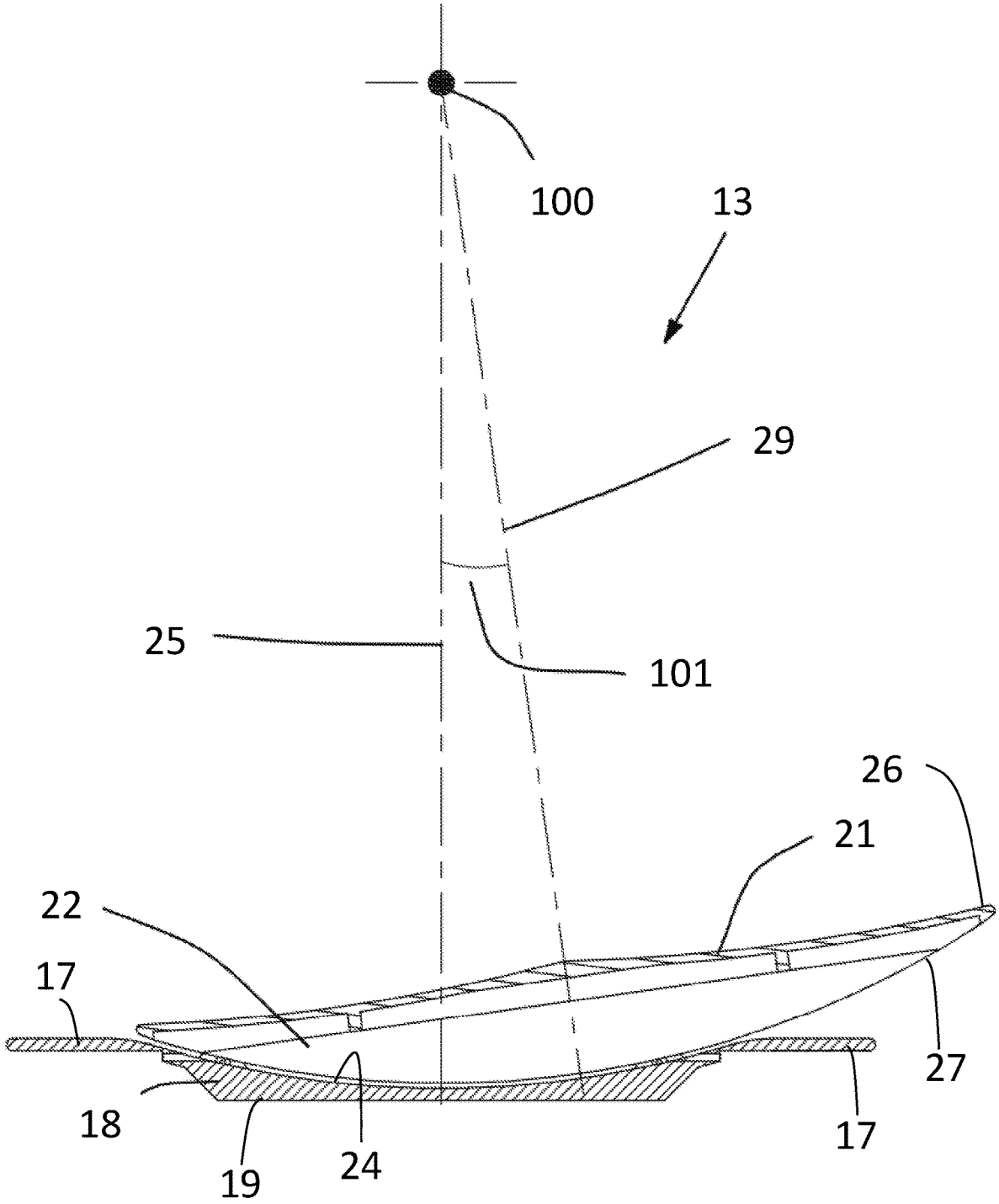
Figure 32:
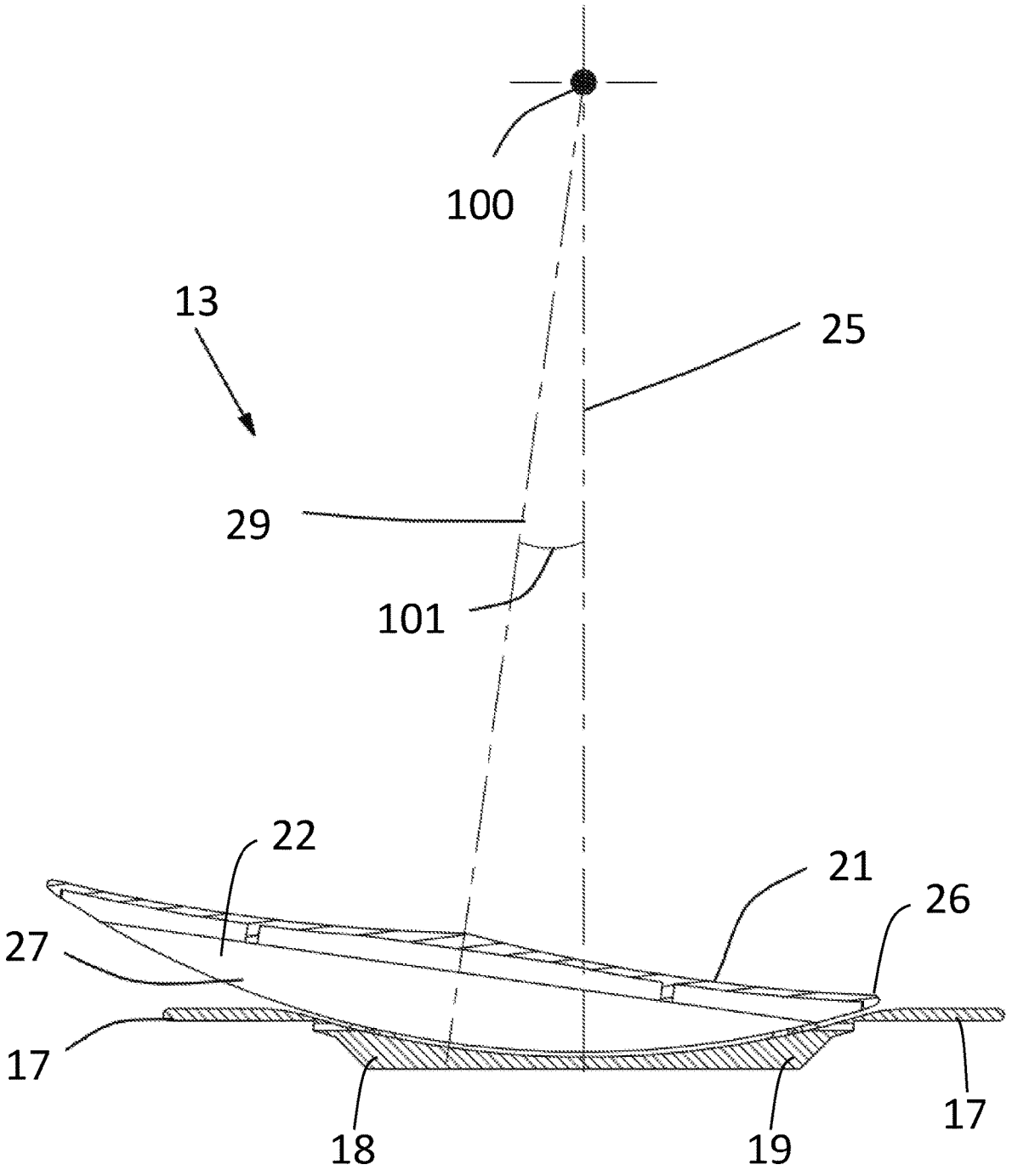

FIG. 30 is a first sequential lateral cross-sectional depiction of the third alternative embodiment of the lower back exercise apparatus according to the present invention showing an upper seat assembly in a central equilibrium position relative to a lower base assembly, the upper seat assembly being movable relative to the lower base assembly in a pendulum swing type motion as generally and comparatively further depicted in FIGS. 31 and 32.

FIG. 31 is a second sequential lateral cross-sectional depiction of the third alternative embodiment of the lower back exercise apparatus according to the present invention showing the upper seat assembly in a maximum right arc position relative to the lower base assembly, the upper seat assembly being movable relative to the lower base assembly in a pendulum swing type motion as generally and comparatively further depicted in FIGS. 30 and 32.

FIG. 32 is a third sequential diagrammatic depiction of the third alternative embodiment of the lower back exercise apparatus according to the present invention showing the upper seat assembly in a maximum left arc position relative to the lower base assembly, the upper seat assembly being movable relative to the lower base assembly in a pendulum swing type motion as generally and comparatively further depicted in FIGS. 30 and 31.

Figure 33:
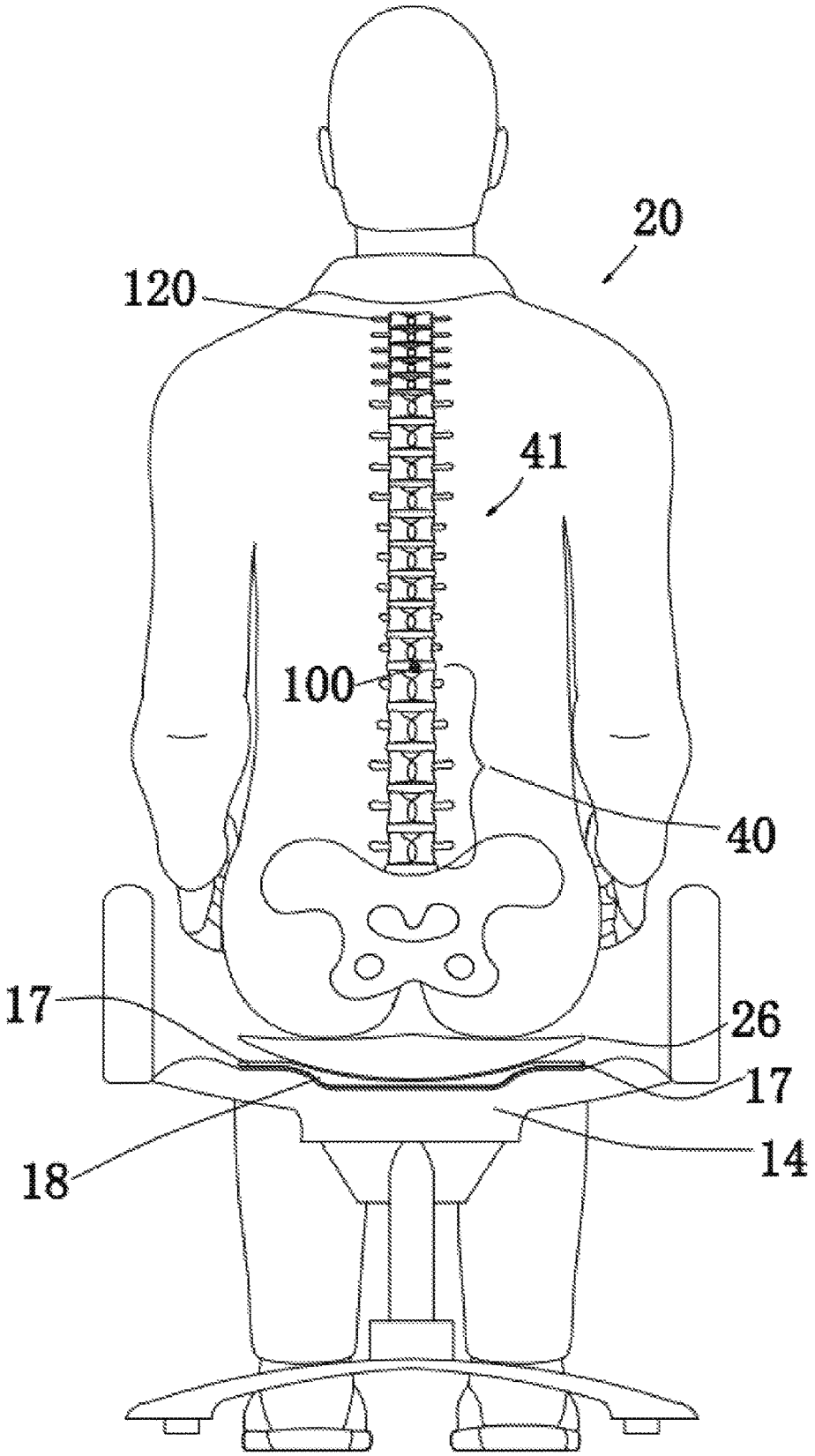

FIG. 33 is a first sequential diagrammatic depiction of a user with highlighted spinal column seated upon a portable generic lower back exercise apparatus according to the present invention with the upper seat assembly shown in a central equilibrium position to show a linearly aligned spinal column when the user is seated upon the apparatus in the central equilibrium position.

Figure 34:
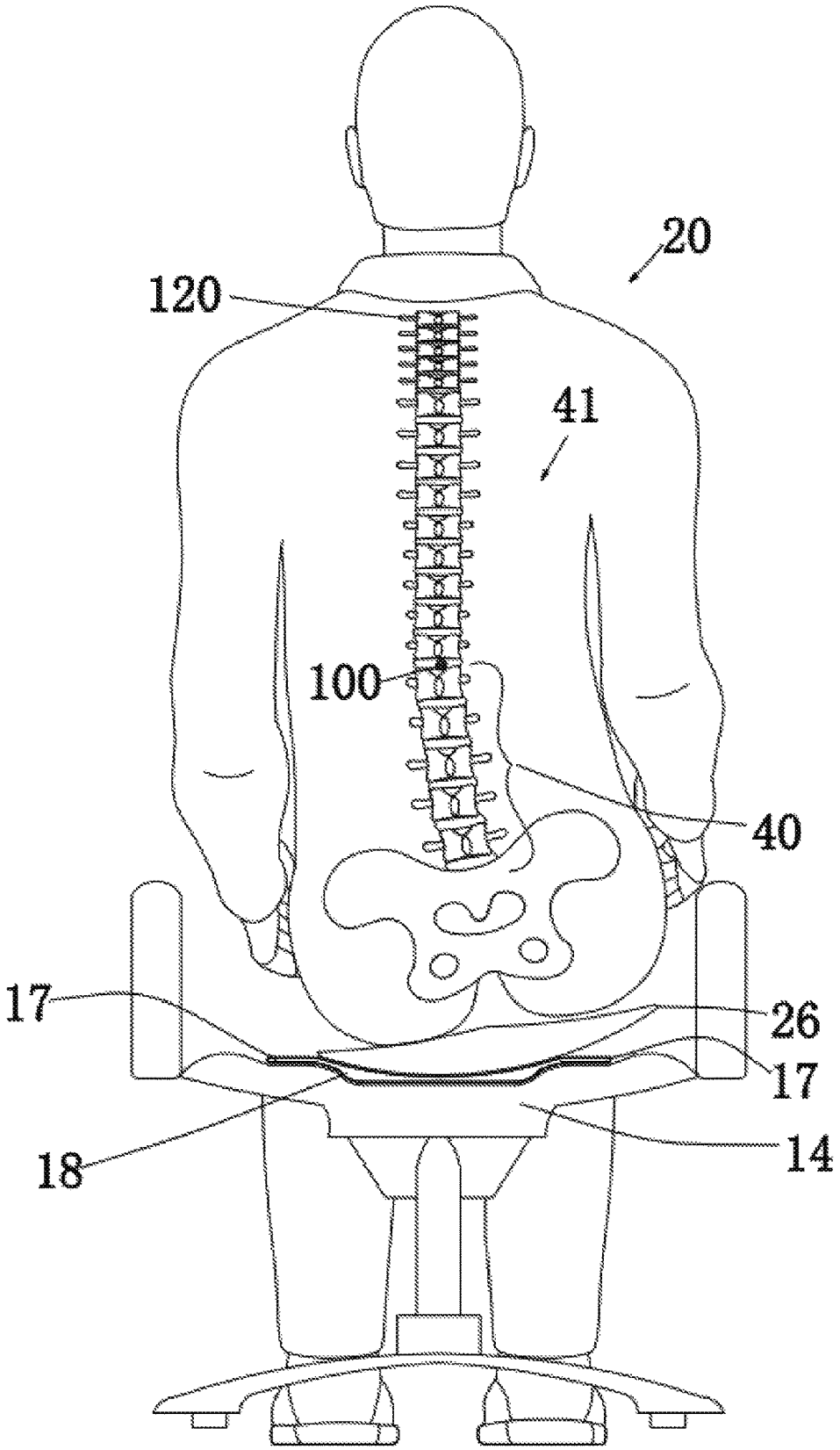

FIG. 34 is a second sequential diagrammatic depiction of a user with highlighted spinal column seated upon a portable generic lower back exercise apparatus according to the present invention with the upper seat assembly shown in a maximum left arc position to show the lumbar region of the spinal column shifted laterally left and upwardly when the user is seated upon the apparatus in the maximum left arc position without the need of any upper body shift/movement.

Figure 35:
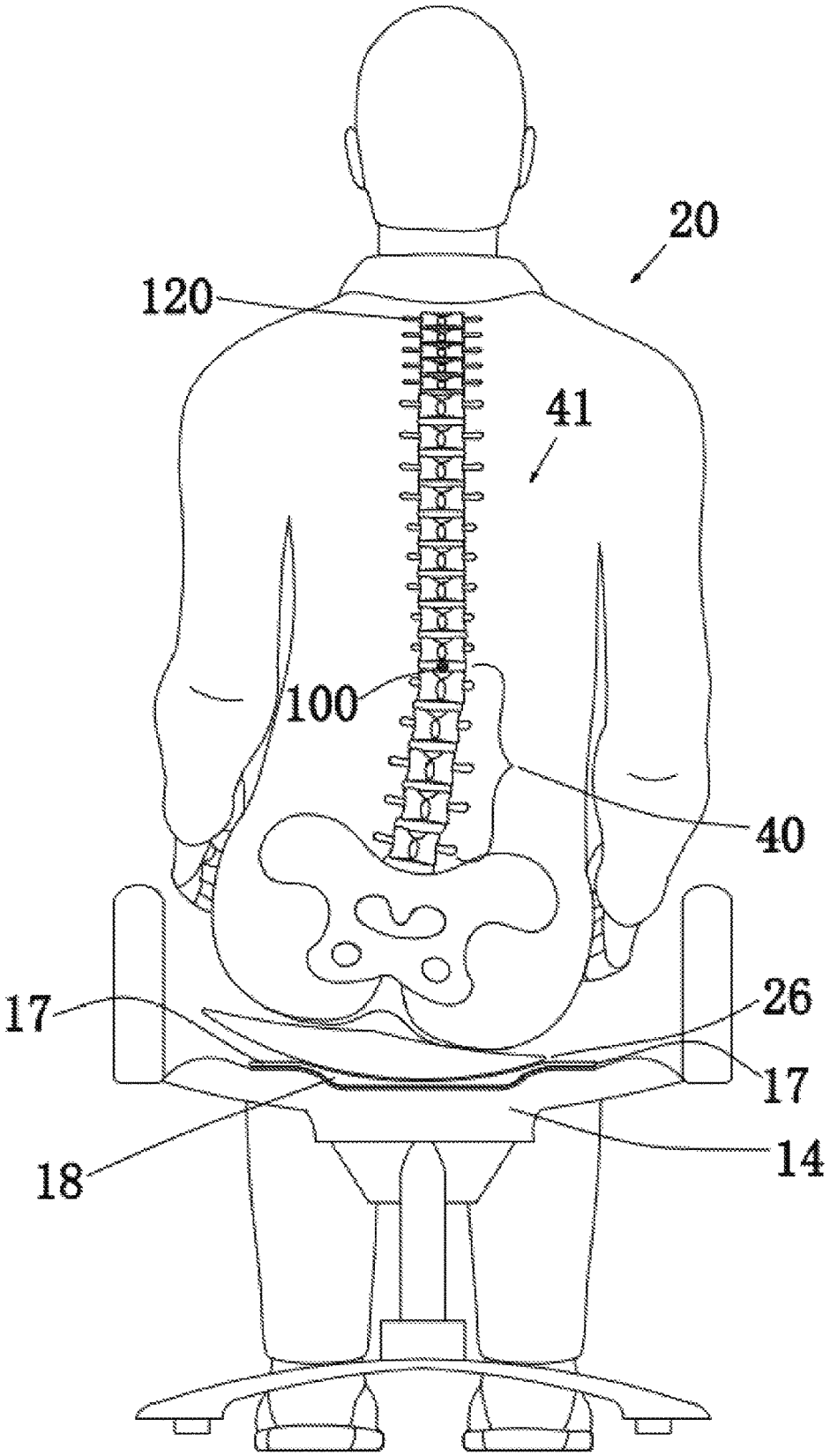

FIG. 35 is a third sequential diagrammatic depiction of a user with highlighted spinal column seated upon a portable generic lower back exercise apparatus according to the present invention with the upper seat assembly shown in a maximum right arc position to show the lumbar region of the spinal column shifted laterally right and upwardly when the user is seated upon the apparatus in the maximum right arc position without the need of any upper body shift/movement.

Figure 36C:
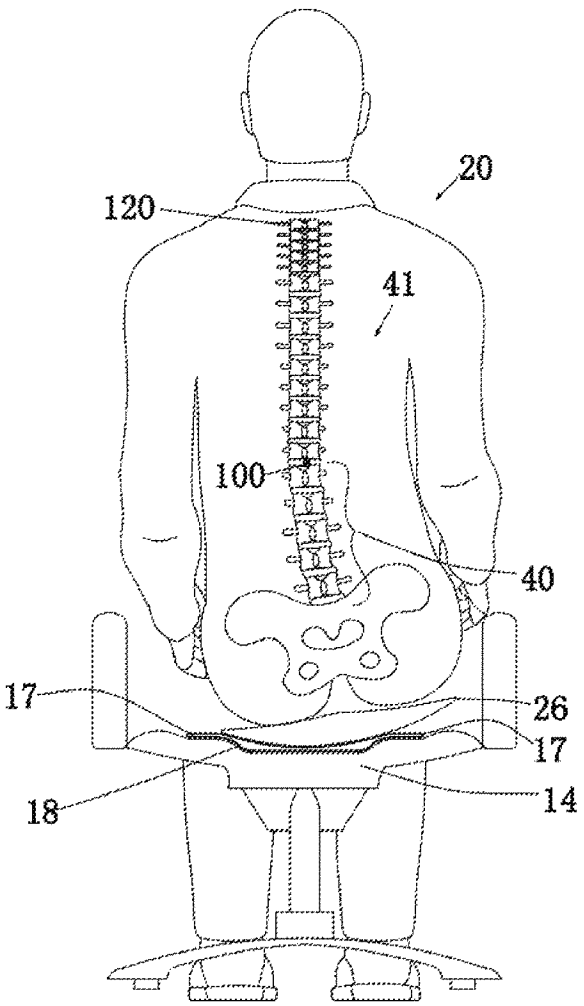
Figure 36B:
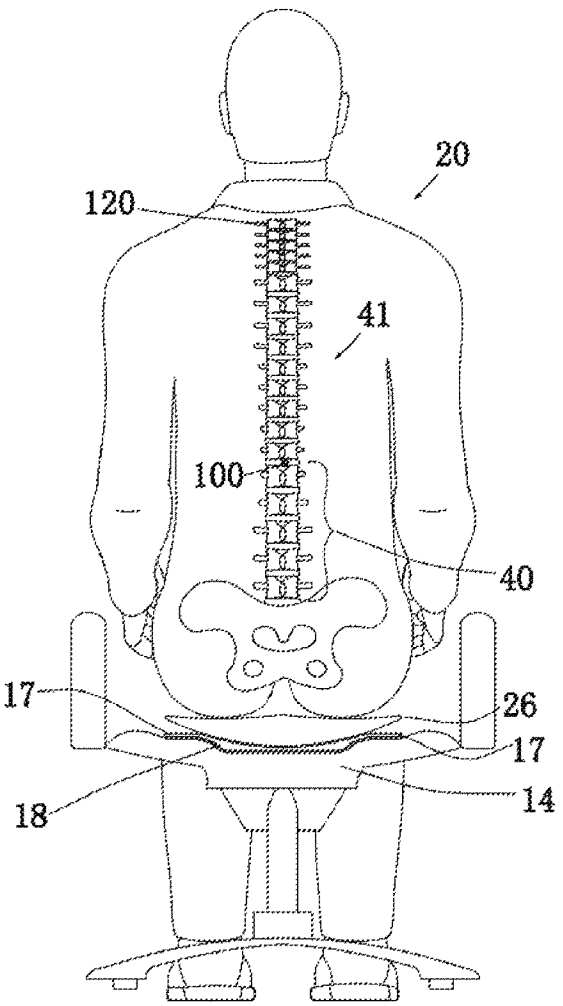
Figure 36A:
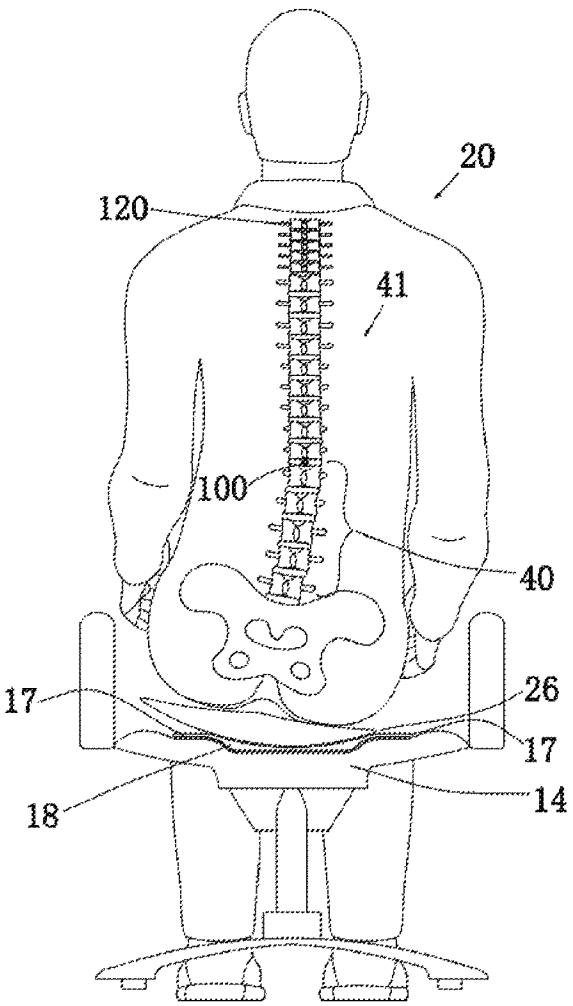

FIG. 36A is a first comparative diagrammatic depiction of a user with highlighted spinal column seated upon a portable generic lower back exercise apparatus according to the present invention with the upper seat assembly shown in the maximum left arc position to show the lumbar region of the spinal column shifted laterally left and upwardly when the user is seated upon the apparatus in the maximum left arc position without the need of any upper body shift/movement, the first comparative diagrammatic depiction being shown in side-by-side relation to FIGS. 36B and 36C for ease of comparison.

FIG. 36B is a second comparative diagrammatic depiction of a user with highlighted spinal column seated upon a portable generic lower back exercise apparatus according to the present invention with the upper seat assembly shown in a central equilibrium position to show a linearly aligned spinal column when the user is seated upon the apparatus in the central equilibrium position without the need of any upper body shift/movement, the second comparative diagrammatic depiction being shown in side-by-side relation to FIGS. 36A and 36C for ease of comparison.

FIG. 36C is a third comparative diagrammatic depiction of a user with highlighted spinal column seated upon a portable generic lower back exercise apparatus according to the present invention with the upper seat assembly shown in the maximum right arc position to show the lumbar region of the spinal column shifted laterally right and upwardly when the user is seated upon the apparatus in the maximum right arc position without the need of any upper body shift/movement, the third comparative diagrammatic depiction being shown in side-by-side relation to FIGS. 36A and 36B for ease of comparison.

Figure 37:
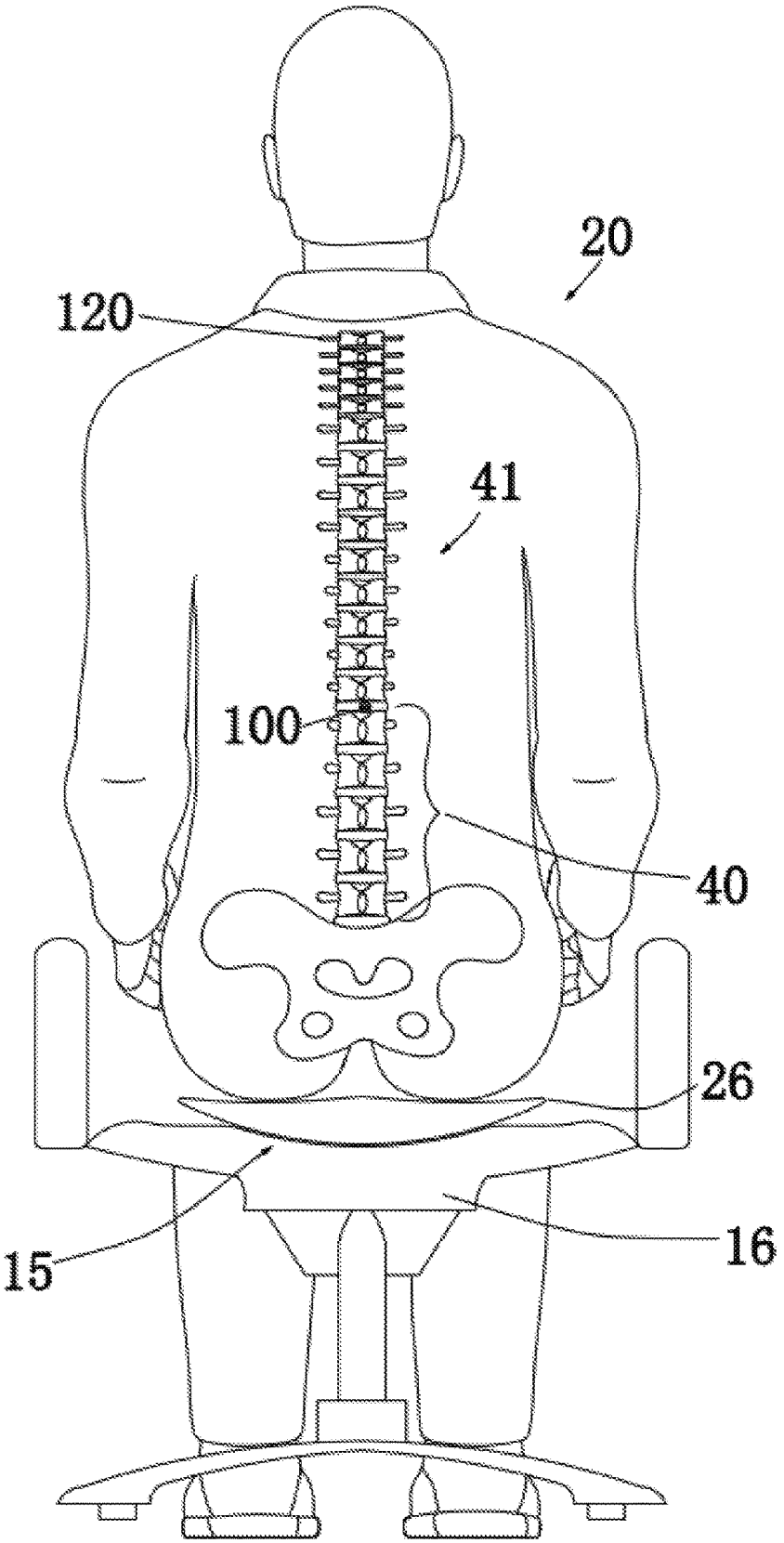

FIG. 37 is a first sequential diagrammatic depiction of a user with highlighted spinal column seated upon a built-in, chair construction type lower back exercise apparatus according to the present invention with the upper seat assembly shown in a central equilibrium position to show a linearly aligned spinal column when the user is seated upon the apparatus in the central equilibrium position without the need of any upper body shift/movement.

Figure 38:
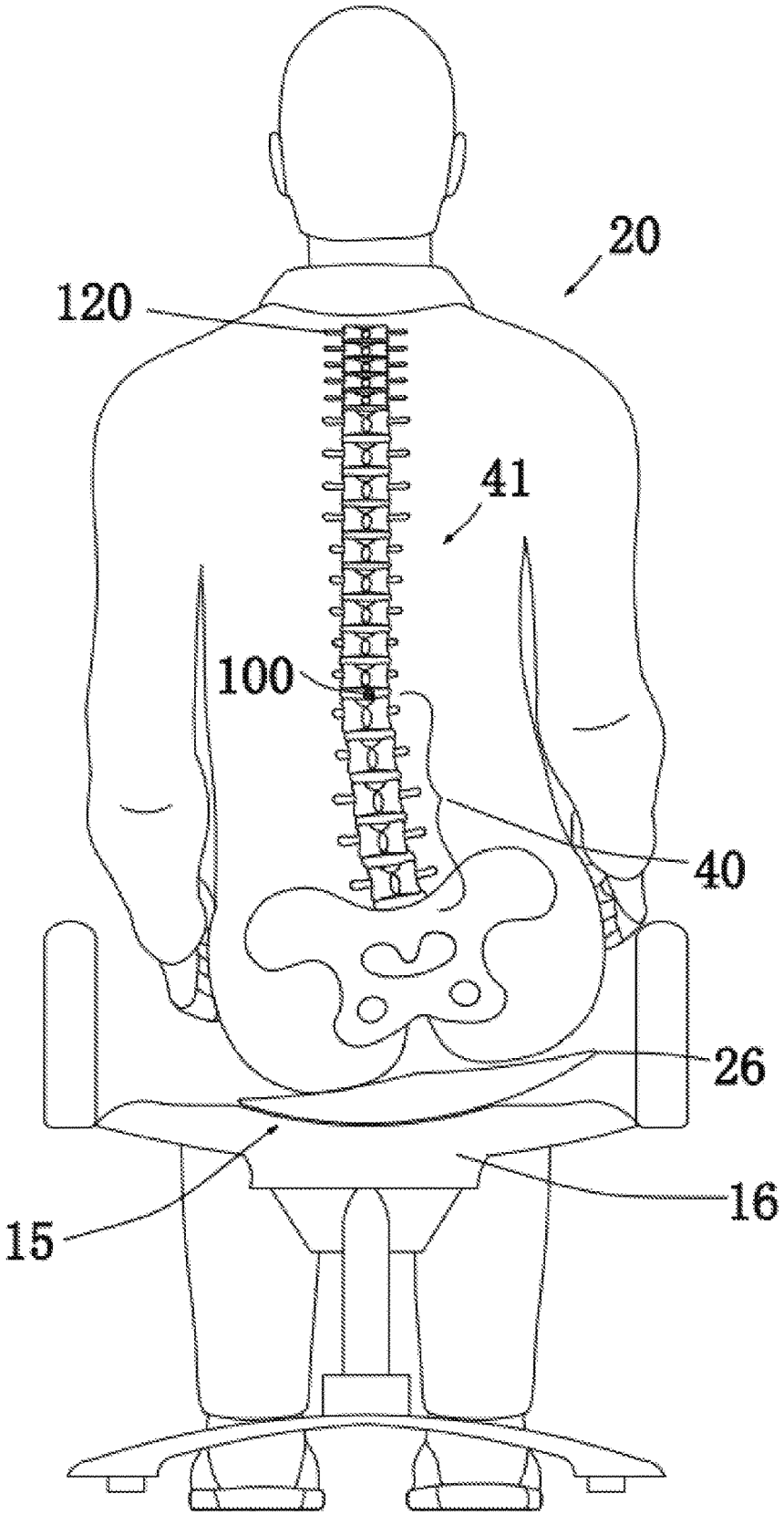

FIG. 38 is a second sequential diagrammatic depiction of a user with highlighted spinal column seated upon a built-in, chair construction type lower back exercise apparatus according to the present invention with the upper seat assembly shown in a maximum left arc position to show the lumbar region of the spinal column shifted laterally left and upwardly when the user is seated upon the apparatus in the maximum left arc position without the need of any upper body shift/movement.

Figure 39:
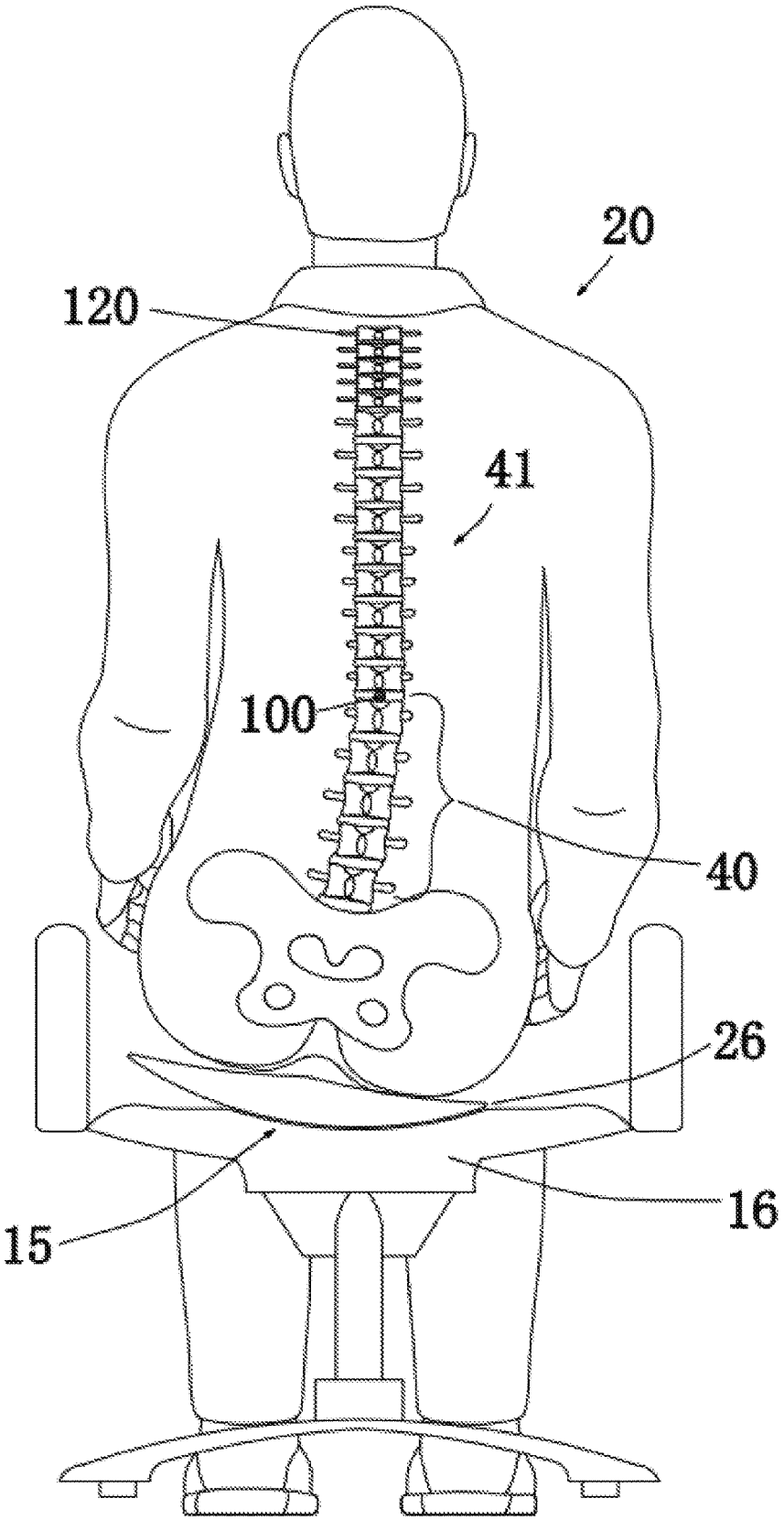

FIG. 39 is a third sequential diagrammatic depiction of a user with highlighted spinal column seated upon a built-in, chair construction type lower back exercise apparatus according to the present invention with the upper seat assembly shown in a maximum right arc position to show the lumbar region of the spinal column shifted laterally right and upwardly when the user is seated upon the apparatus in the maximum right arc position without the need of any upper body shift/movement.

Figure 40C:
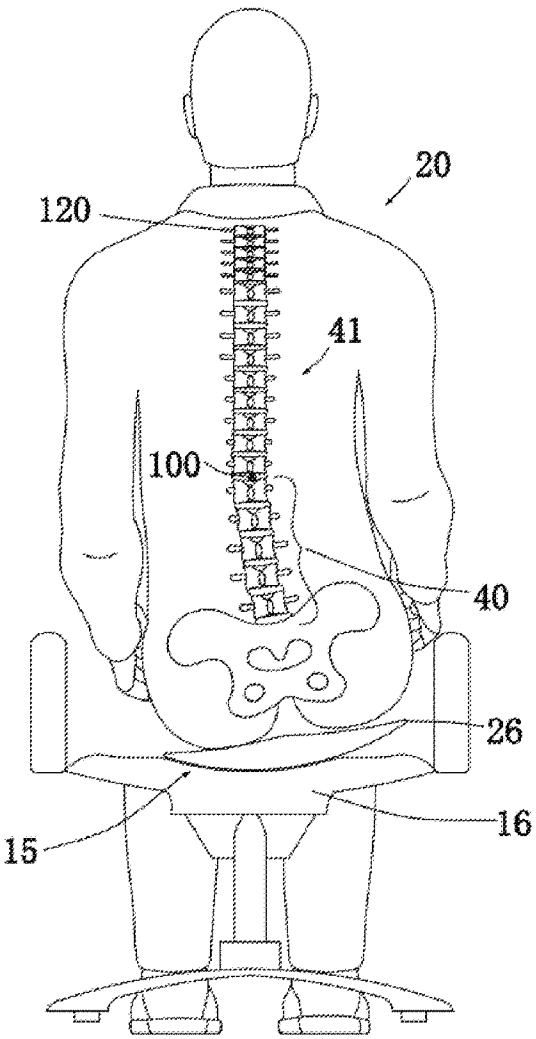
Figure 40B:
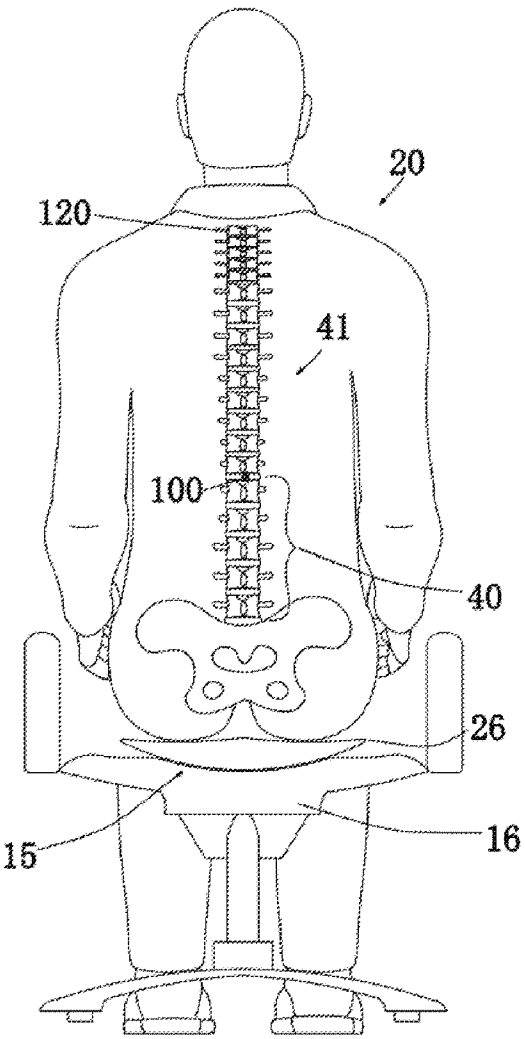
Figure 40A:
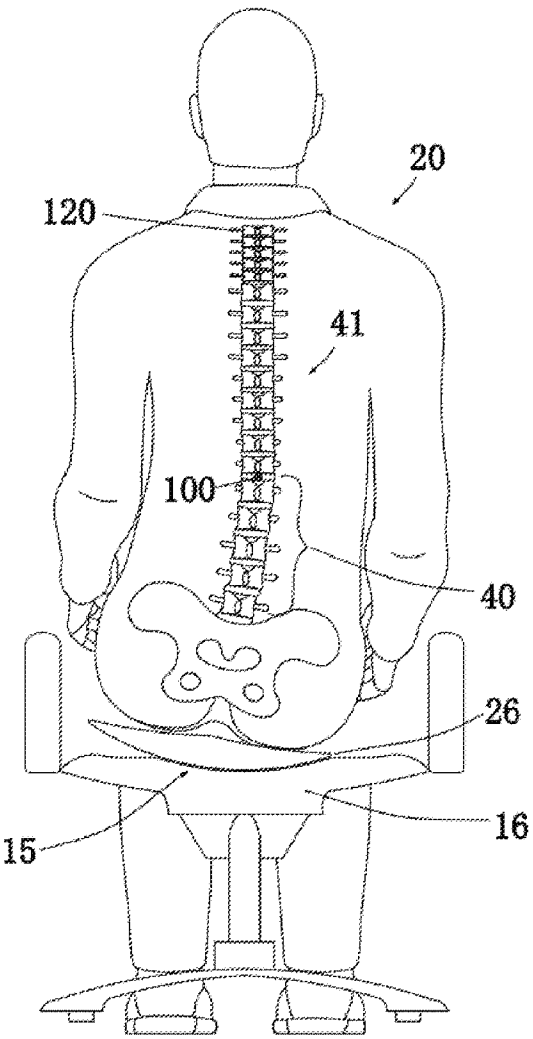

FIG. 40A is a first comparative diagrammatic depiction of a user with highlighted spinal column seated upon a built-in, chair construction type lower back exercise apparatus according to the present invention with the upper seat assembly shown in the maximum left arc position to show the lumbar region of the spinal column shifted laterally left and upwardly when the user is seated upon the apparatus in the maximum left arc position without the need of any upper body shift/movement, the first comparative diagrammatic depiction being shown in side-by-side relation to FIGS. 40B and 40C for ease of comparison.

FIG. 40B is a second comparative diagrammatic depiction of a user with highlighted spinal column seated upon a built-in, chair construction type lower back exercise apparatus according to the present invention with the upper seat assembly shown in a central equilibrium position to show a linearly aligned spinal column when the user is seated upon the apparatus in the central equilibrium position without the need of any upper body shift/movement, the second comparative diagrammatic depiction being shown in side-by-side relation to FIGS. 40A and 40C for ease of comparison.

FIG. 40C is a third comparative diagrammatic depiction of a user with highlighted spinal column seated upon a built-in, chair construction type lower back exercise apparatus according to the present invention with the upper seat assembly shown in the maximum right arc position to show the lumbar region of the spinal column shifted laterally right and upwardly when the user is seated upon the apparatus in the maximum right arc position without the need of any upper body shift/movement, the third comparative diagrammatic depiction being shown in side-by-side relation to FIGS. 40A and 40B for ease of comparison.

Figure 41:
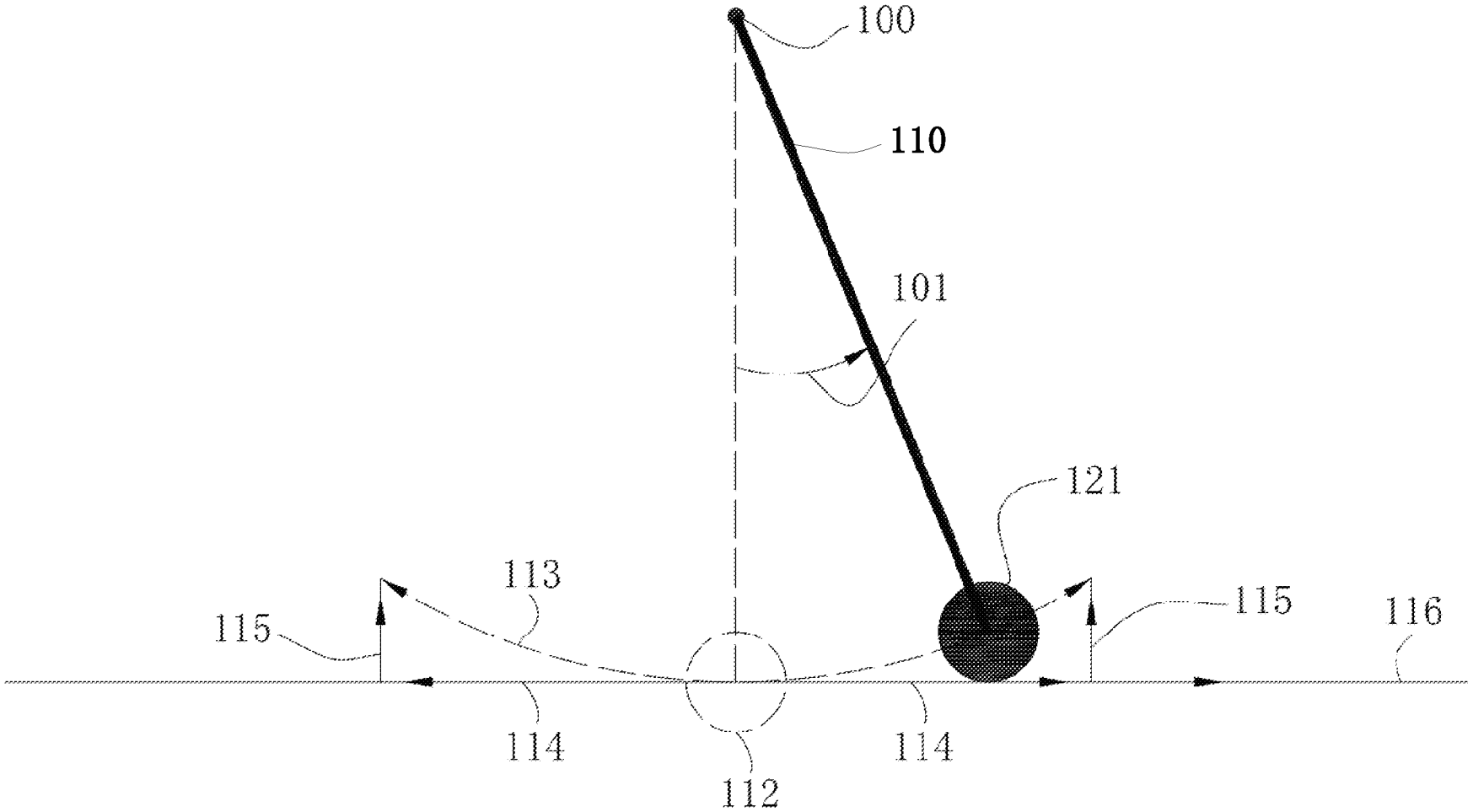

FIG. 41 is a diagrammatic depiction of a simple gravity pendulum showing a frictionless pivot, a massless rod, and a massive bob with a defined angular amplitude, an equilibrium position, and an overall bob trajectory having lateral and upward displacements relative to a horizontal.

Figure 42:
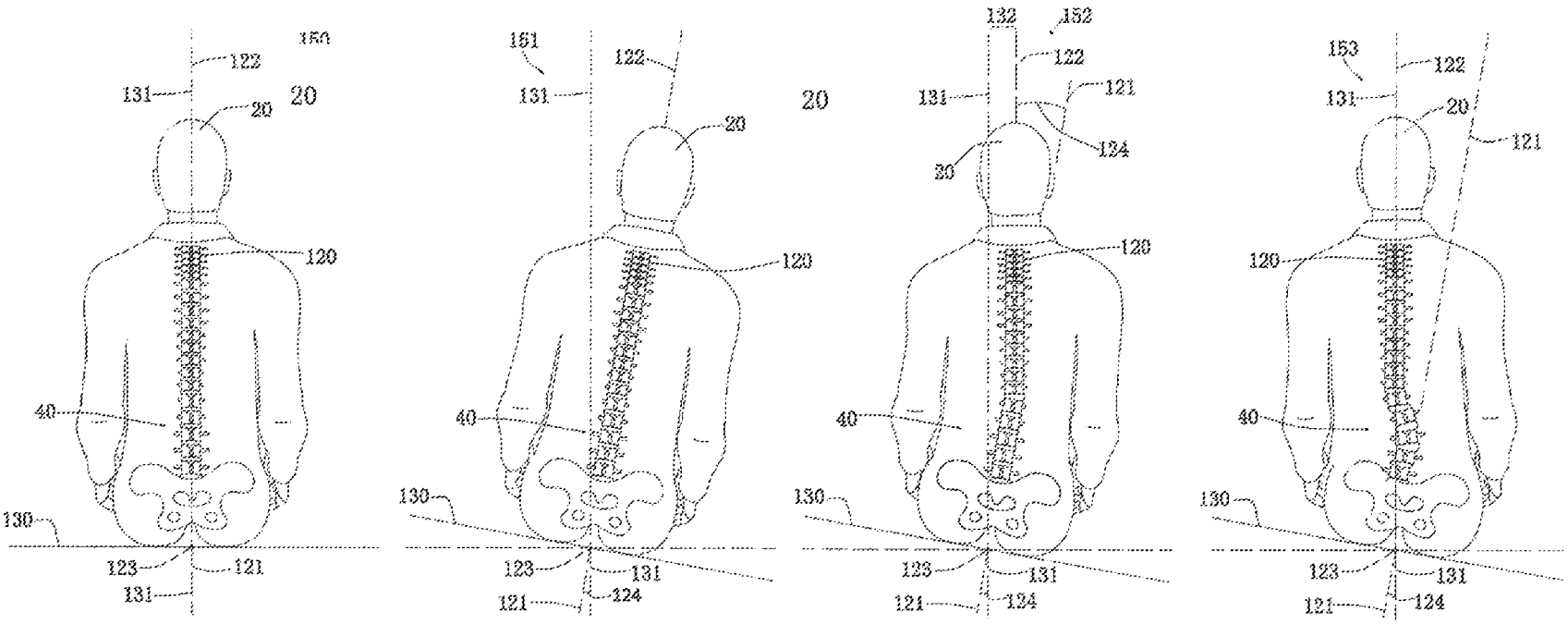

FIG. 42 is a set of four depictions of user with highlighted spinal column seated upon a support plane with the support plane and anatomical position of the user as seated upon the support plane being shown in various positional configurations to show the highlighted spinal column in various spinal configurations.

Figure 43:
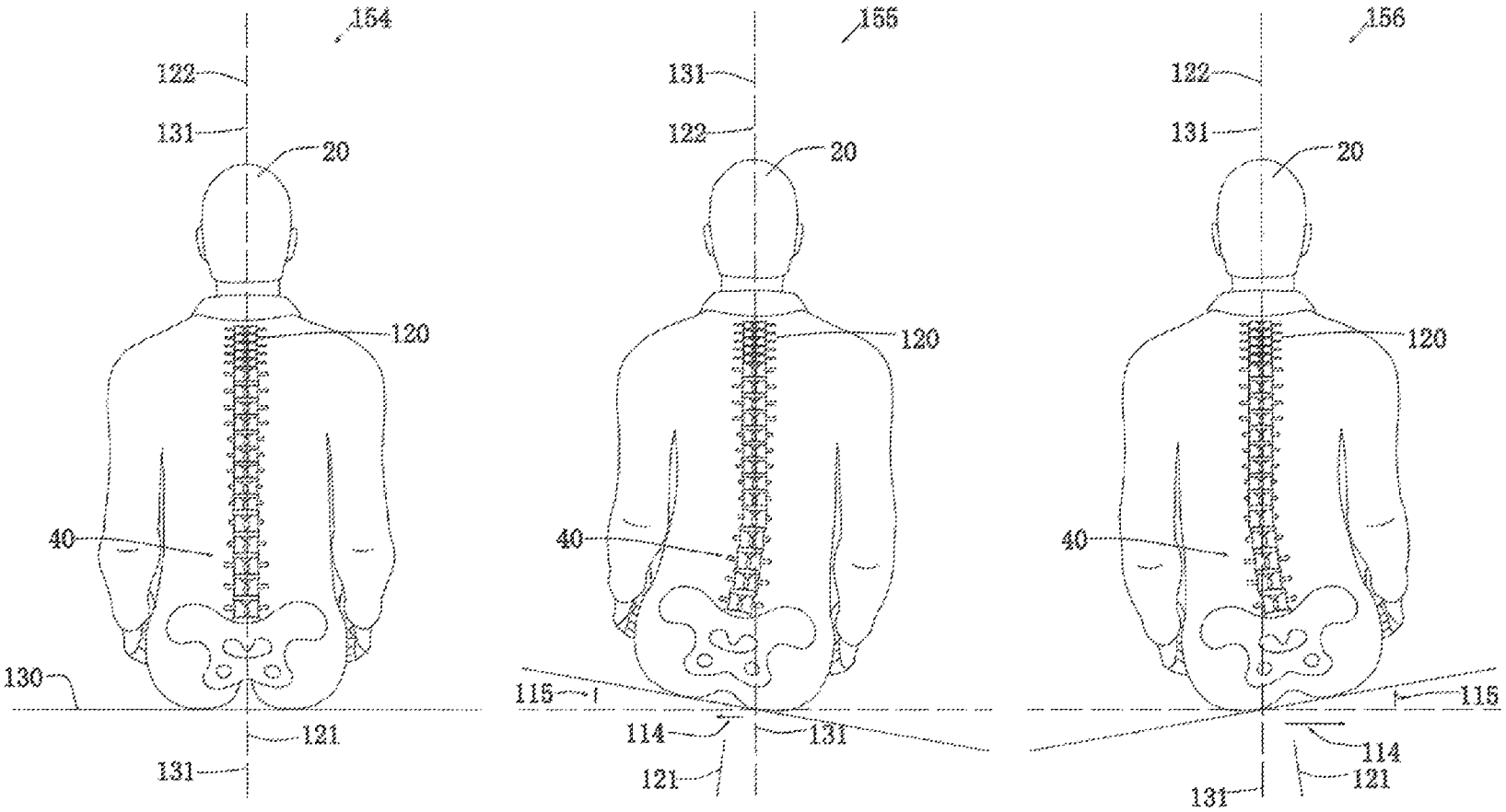

FIG. 43 is a set of three depictions of user with highlighted spinal column seated upon a support plane provided by the present invention with the support plane and anatomical position of the user as seated upon the support plane being shown in various positional configurations to show the highlighted spinal column in various spinal configurations.

DETAILED DESCRIPTION OF THE PREFERRED EMBODIMENTS

Referring now to the drawings with more specificity, the present invention preferably provides a lower back exercise apparatus for exercising or imparting lateral flexion movements into a user's lower back or lumbar region 40 when a user 20 is seated thereupon as generally and comparatively depicted in FIGS. 33-40C, 42, and 43. The lower back exercise apparatus contemplated by these specifications may be provided in a number of alternative embodiments, and in this regard, can be mechanized or manually driven.

These specifications and the drawings submitted in support thereof thus describe or contemplate at least six versions or embodiments of the lower back exercise apparatus according to the present invention and include both mechanized and manual versions of either a portable unit type for placement upon a seat support surface or as built-in type in which case the basic concepts are built-into a seat construction as in the case of an office chair or similar other chair assembly. More particularly, a single (1) manual version and two (2) alternative mechanized versions (or 3 total versions) can be formed as either a stand-alone apparatus or built-in to a chair construction (2 types) and thus at least six (6) alternative embodiments (3 versions×2 types) are contemplated by these specifications.

All of the versions or embodiments are bound to one another by a unifying structural concept for exercising or imparting motion into a user's lower back so as to isolate lower spine or lumbar spine 40 movements such that the lower spinal terminus may be directed to and fro laterally while maintaining vertical alignment of the upper back or upper spine portion 41. The preferred movements follow a cylindrical arc length akin to a simple gravity pendulum swing trajectory whereby displacements from a central vertically aligned equilibrium position are characterized by lateral and upward vector components and imparted cyclically or periodically in manner over time as generally depicted in FIG. 41.

The lower back exercise apparatus depicted and referenced at 10 is a generic, mechanized portable seat construction or apparatus with internal mechanization hidden from view but showing an external control module as at 42 with a fragmentary power cord 43 leading therefrom. It is contemplated that the preferred embodiments include mechanization as opposed to the alternative manual version, the latter of which necessarily requires the user to direct his or her own energy into the device to effect movement.

The lower back exercise apparatus depicted and referenced at 11 is a first mechanized design or alternative embodiment and the lower back exercise apparatus depicted and referenced at 12 is a second mechanized design or alternative embodiment according to the present invention. A third manually driven design or alternative embodiment is depicted and referenced at 13. The embodiments 10-13 are all depicted as a stand-alone or portable apparatus usable for placement atop a seat support surface. A final embodiment shown in the drawings is a built-in type embodiment as depicted and referenced at 15. As referenced, the embodiment 15 contemplates or embraces either of the two preferred mechanized versions or the single manually driven version.

The first, mechanized alternative embodiment of the lower back exercise apparatus is more particularly depicted and referenced at 11 in FIGS. 6-13; the second, mechanized alternative embodiment of the lower back exercise apparatus is more particularly depicted and referenced at 12 in FIGS. 14-22; and the third, manually driven alternative embodiment of the lower back exercise apparatus is more particularly depicted and referenced at 13 in FIGS. 23-32. The primary structural differences between the first alternative embodiment 11 and the second alternative embodiment 12 stem from the type of motor assembly and associated components utilized to impart the lateral rocking motion along a laterally-directed, cylindrical arc length trajectory typified by a pendulum swing type motion having a center point or fulcrum as at 100 as generally depicted in FIG. 41.

The primary structural differences between the first and second mechanized alternative embodiments 11 and 12 versus the third alternative embodiment 13 stem from the removal of the motor assembly and associated components from the first and second mechanized alternative embodiments 11 and 12 relative to the third, manually driven alternative embodiment 13. The motor assemblies and associated components of the first and second mechanized alternative embodiments 11 and 12 are utilized to impart the lateral and upward displacements along the laterally-directed, cylindrical arc length trajectory typified by a pendulum swing type motion. In contrast thereto, the user imparts his or her own forces into the third, manually driven embodiment 13 to effect the same type of motion.

Referencing FIG. 41 the reader will there note a diagrammatic depiction of a simple gravity pendulum showing a frictionless pivot as at fulcrum 100, a massless rod as at 110, and a massive bob as at 121 with a defined angular amplitude as at 101; an equilibrium position as at 112, and an overall bob trajectory 113 having left and right lateral displacements as at vectors 114 and upward displacements as at 115 relative to a horizontal line as at 116 tangent to the equilibrium position 112. The lower back exercise apparatus, however embodied, imparts motion of trajectory 113 into a user's lumbar region 40 via any of alternative mechanizations or deployments thereby isolating to and fro movement at the lumbar spine region 40.

Comparatively referencing FIG. 42 versus FIG. 43, the reader will there consider certain anatomical configurations of the human spine 120 with lower lumbar region 40 as viewed from a posterior perspective when a user 20 is seated upon a seat support plane as at 130. The series of depictions in FIG. 42 represent state or the art or prior art back exercise contraptions whereby a user's lower back is subjected to less effective movement regimens. The series of depictions in FIG. 43, by contrast, demonstrate the to and fro movement of the lumbar spine region 40 enabled by way of the lower back exercise apparatus according to the present invention.

The user 20 is seated upon a seat support plane 130 with a perfectly vertically aligned spinal column 120 as at 150 in FIG. 42. In other words, the reader will note that the lower spinal axis 121 of the lumbar spine region 40 is orthogonal to the seat support plane 130 and coplanar with the upper spinal axis 122 and vertical seat plane 131. When the seat support plane 130 is rotated about a fixed pivot point 123 as is the case with most prior art contraptions, the spinal axes 121 and 122 shift an angle 124 from vertical 131.

In the hypothetical scenario 151, the spinal axes 121 and 122 remain aligned, and the user 20 will experience a downward force (not specifically depicted) since the center of mass of the upper torso will have moved out of vertical alignment thereby tending to direct the user 20 downwardly under gravitation forces. To correct for this, the user 20 will normally adjust or shift his upper spinal axis 122 into a more vertical alignment as generally depicted in anatomical scenario 152. The reader will thus note that the lower spinal axis 121 remains at an angle 124 from vertical plane 131 while the upper spinal axis 122 tends toward a parallel relationship with vertical plane 131 offset some small distance 132 therefrom. This anatomical scenario 152 stresses the lumbar spinal region 40 and core musculature in support thereof.

To relieve the stress or in cases where a user's core musculature is insufficient to retain anatomical scenario 152, some users 20 readjust their anatomy toward anatomical scenario 153. Referencing the lumbar spine region 40 in anatomical scenario 153, the reader will note the S-shaped anatomical configuration of the lumbar spine region 40 whereby the upper spinal axis 122 tends toward vertical alignment with vertical plane 131 while the lower spinal axis 121 remains at an angle 124 via the rotation about point 123 via the prior art contraptions.

The lower back exercise apparatus according to the present invention, as variously exemplified, remedies the S-shaped lower anatomical or lumbar spine configuration by providing for a-shaped anatomical spine configuration whereby by the spinal terminus is (a) laterally and (b) upwardly displaced as at vector arrows 114 and 115 as further depicted in FIG. 43. The lateral and upward displacements 114 and 115 are central to the practice of the present invention, and eliminate the S-shaped anatomical configuration otherwise depicted at lumbar spine region 40 in anatomical scenario 153 and provided by prior art contraptions.

In this last regard, anatomical scenario 154 as depicted in FIG. 43 depicts an equilibrium position whereby the user's spinal column 120 is in vertical alignment with the vertical plane 131. The lateral and upward displacements 114 and 115 depicted in anatomical scenarios 155 and 156 show how the lower spinal axis is moved out of alignment with the vertical plane 131, but in so doing the lower torso anatomy is simultaneously laterally shifted via lateral displacements 114 and upward displacements 115 along a fixed (and periodic) cylindrical arc length trajectory so as to impart the curvature of the-shaped anatomical spine configuration there depicted. The reader will note that the user's upper spinal axis 122 remains in alignment with the vertical plane 131 and the lumbar spine movements are thus isolated.

To achieve the primary objective of imparting the isolated lumbar spine movements as heretofore described, the present invention provides either portable unit types (3 versions) or built-in chair unit types (3 versions). The portable unit types are generally and comparatively depicted and referenced in FIGS. 1-36C. The reader will note from a comparative inspection of FIGS. 1-36C that the lower back exercise apparatus embodiments according to the present invention, when provided as a stand-alone or portable exercise unit type, may be placed upon other seats such as a state of the art chair constructions as at 14 for periodic use and exercise by a human user 20.

FIGS. 37-40C, in contrast to the unit types depicted in FIGS. 1-36C, attempt to generically depict the mechanized and manual lower back exercise apparatus embodiment(s) or versions according to the present invention as built-in or integrally formed with a chair construction (i.e. a combination type chair construction) as referenced at 15. The lower back exercise apparatus 15 thus provides a lower base assembly 16 integrally formed with lower portions of a typical chair construction, and an upper seat assembly 26 made cooperable with the lower base assembly 16.

The basic or essential lower back exercise apparatus according to the present invention, whether mechanized or manually driven, preferably comprises or includes a lower base assembly as at 16 for the built-in unit or combination chair construction embodiment 15 or as at 18 for the stand-alone units or apparatuses as variously referenced. The lower base assemblies as at 16 or 18 both preferably comprise or include a lower central pedestal section 19 and laterally extending wing elements as at 17.

The central pedestal section 19 most importantly comprises or includes an upper, laterally concave base surface as at 24. The upper, laterally concave base surface 24 preferably comprises or provides a substantially uniform base radius of curvature as at 25 along its cylindrical, lateral arc length. In the case of mechanized lower back exercise apparatuses 11, 12, and 13, the lower base assemblies 16 or 18 preferably further comprise or include a series of seat support wheel bearing assemblies as at 30.

Preferably, there are at least two series or sets of wheel bearing assemblies 30 laterally spaced from one another and configured so as to enable lower portions of wheel bearings 33 to be set into or recessed relative the upper, laterally concave base surface 24. The two series of sets of wheel bearing assemblies 30 are preferably situated inwardly of or centrally to the laterally extending wing elements 17 in superior adjacency to bearing-accommodating regions of the lower central pedestal section 19.

The reader will note that the seat support wheel bearing assemblies 30, as illustrated, may preferably number four in each set or series. The seat support wheel bearing assemblies 30 may preferably be mounted adjacent recessed cavities formed in the upper, laterally concave base surface 24 extending into the bearing-accommodating regions 31 such that the axes of rotation extend parallel to the upper, laterally concave base surface 24.

More particularly, wheel supports 32 mount the seat support wheel bearings 33 such that the axes of rotation of the wheel bearings 33 are parallel to one another and in superficial adjacency to the upper, laterally concave base surface 24 with the cavities formed in the bearing-accommodating portions 31 of the central pedestal section 19 for receiving lower portions of the seat support wheel bearings 33 at the sites of the wheel supports 32, the lower portions wheel bearings 33 extending into the bearing-accommodating regions 31 of the central pedestal section 19. Each seat support wheel bearing 33 comprises a bearing diameter that extends across an interface plane extending between the upper, laterally concave base surface 24 and the lower, laterally convex seat surface 27 of the upper seat assembly 26.

Longitudinally spaced cover locking pins 34 extend upwardly from the upper, laterally concave surface 24 of the lower central pedestal section 19 for further providing lower portions of an upper-to-lower alignment mechanism for maintaining the alignment of the upper seat assembly 26 relative to the lower base assemblies 16 or 18 during pendulum swing or lateral rocking movements. Upper pinreceiving slots 35 formed as part of the upper seat assembly 26 are translatably matable with the cover locking pins 34. The pins 34 are thus translatably received in the slots 35 for maintain proper alignment of the upper seat assembly 26 relative to the lower seat assemblies 16/18 during pendulum swing or lateral rocking movements.

Upper portions of the seat support wheel bearings 33 are further received in bearing-receiving slots, bearing-receiving grooves or bearing-receiving tracks 36 formed in the lower, laterally convex surface 27 of the upper seat assembly 26. The reader will note that the upper seat assembly 26 preferably comprises a two-piece construction comprising an upper user-to-apparatus interface element or top cover element as at 21, and a lower upper-to-lower interface element or lower cover element as at 22.

As stated, the basic or essential lower back exercise apparatus according to the present invention, whether mechanized or manually drive, portable or built-in, all further preferably comprise or include an upper seat assembly as at 26. The upper seat assembly 26 preferably further comprises or includes a lower, laterally convex seat surface 27 and an upper seat surface 28 for interfacing with a user 20. The lower, laterally convex seat surface 27 preferably comprises or includes a substantially uniform seat radius of curvature 29 that coincides with or is substantially equal to the base radius of curvature 25 along its entire lateral arc length. The upper seat assembly 26 is ridable upon and/or movable relative to the lower base assemblies 16 or 18 such that the upper, laterally concave base surface 24 and the lower, laterally convex seat surface 27 oppose one another.

The upper seat assembly 26 may preferably further comprise or include an upper seat portion or section as at 21 and a lower seat portion or section as at 22. The upper seat portion 21 provides the upper seat surfacing 28, preferably contoured for receiving a user's anatomy, and the lower seat portion 22 preferably provides the lower, laterally convex surfacing 27 in which surfacing 27 are formed the bearing-receiving slots or grooves or tracks 36. The lower seat portion 22 of the mechanized lower back exercise apparatuses 11 and 12 each further comprise or include a central assembly-receiving pocket or aperture as at 23 recessed from the surface 27 for receiving a step motor assembly 37. The assembly-receiving pocket or aperture 23 structurally coincides or cooperates with the motor assembly-receiving pocket or cavity 38 formed in the upper seat portion or section as at 21.

Recalling that the assembly-receiving pocket or cavity 23 of the lower seat portion or section 22 structurally coincides with the motor assembly-receiving pocket or cavity 38 formed in the upper seat portion or section 21, the lower back exercise apparatus according to the present invention operates under mechanical driving forces provided by way of the step motor assembly 37, components of which are structurally accommodated by the cooperative assembly-receiving pocket or cavities 23 and 38 of the upper seat assembly 26.

More particularly in this regard, in lower back exercise apparatus 11, the motor assembly 37 is cooperably associated with the upper seat assembly 26 for effecting a pendulum swing or lateral rocking motion of the upper seat assembly 26 relative to the lower base assemblies 16 or 18 as generally and comparatively depicted in FIGS. 11-13. The pendulum swing or lateral rocking motion for lower back exercise apparatus 12 is generally and comparatively depicted in FIGS. 20-22. A generic pendulum swing or lateral rocking motion is depicted in FIGS. 3-5.

The pendulum swing or lateral rocking motion has a controllable or programmable period and a cylindrical arc length or trajectory coinciding with an angular amplitude 101 defined, in part, by the base and seat radii of curvature 25/29, which base and seat radii of curvature 25/29 have a common fulcrum point as at 100. The fulcrum point 100 is thereby spatially located adjacent an upper portion 41 of a user's lumbar spinal region as at 40. The lower back exercise apparatus according to the present invention thus basically functions to exercise or impart lateral flexion movements into the user's lumbar spinal region 40 when the user 20 is seated thereupon as laterally directed pendulum swing or lateral rocking motion is imparted via the motor assembly 37 and associated controls/structures.

In lower back exercise apparatus 11, the motor assembly 37 and associated components preferably comprise a control box and panel as at 42; a power cord 43 for delivering power to the motor assembly via an external power source (not specifically illustrated); a cable 44; a cable winch 45; cable anchors 46; cable anchor cavities 47; and manual control knobs 48. The cable 44 is anchored to the lower base assemblies 16/18 at both ends via the cable anchor cavities 47 recessed from the surface 24.

Cable anchors 46 anchor the cable ends and the cable is made cooperable with winch 45 such that the motor assembly 37 operates to turn the winch and impart the motion of the upper seat assembly 26 relative to the lower seat assemblies 16/18. The motor assembly 37 and associated components preferably and structurally control the degree of lateral flexion such that the amplitude angle 101 does not exceed roughly 20 rotational degrees. It is contemplated, for example, that an amplitude control knob 48 may be adjusted such that its maximum extent coincides with a maximum amplitude angle 101 of 20 degrees for preventing injury.

In lower back exercise apparatus 12, the motor assembly 37 and associated components preferably comprise control box and panel 42; power cord 43 for delivering power to the motor assembly via an external power source (not specifically illustrated); an arc length gear section or base (rack) gear 49 extending upwardly from the surface 24 longitudinally dividing the upper laterally convex surface 24 into a forward and rearward sections about the plane of the base (rack) gear 49. A motor (pinion) gear 50 is made rotatable via the motor assembly 37 and cooperable with the base (rack) gear 49 for effecting movement parallel to the upper, laterally concave base surface 24 and lower laterally convex seat surface 27.

The motor-driven gear 50 and arc length gear section 49 are flanked intermediate longitudinally spaced seat support wheel bearing assemblies 30 and bearing-receiving slots, grooves, or tracks 36. An electrical circuit is controlled by the user 20 via knob inputs 48 so as to enable the user to adjust the lateral rocking frequency (cycles per min) and lateral rocking amplitude (i.e. amplitude angle 101). Both of these control factors (i.e. periodicity and amplitude) may be manually controlled by the user via the control knobs 48 on the control box or module 42.

In the case of manual lower back exercise apparatus 13, the apparatus 13 basically eliminates the first type of motor assembly and associated components, and thus preferably provides or comprises a lower base assembly 16 or 18 including a series of seat support wheel bearing assemblies as at 30. Preferably, there are at least two series or sets of wheel bearing assemblies 30 longitudinally spaced from one another. In this regard, the reader will note that the seat support wheel bearing assemblies 30, as illustrated, may number four in each set or series.

The seat support wheel bearing assemblies 30 may preferably be mounted to the lower central pedestal section 19 inwardly or centrally relative to the wing elements 17 via wheel supports 32. The wheel supports 32 mount the seat support wheel bearings 33 such that the axes of rotation of the wheel bearings 33 are parallel to one another and in superficial adjacency to the upper laterally concave base surface 24 with cavities formed in bearing-accommodating sections 31 of the central pedestal section 19 for receiving lower portions of the seat support wheel bearings 33 at the sites of the wheel supports 32. Each seat support wheel bearing 30 comprises a bearing diameter that extends across an interface plane extending between the upper, laterally concave base surface 24 and the lower, laterally convex seat surface 27.

While the foregoing specifications set forth much specificity, the same should not be construed as setting forth limits to the invention but rather as setting forth certain preferred embodiments and features. The lower back or lumbar spine exercise apparatus according to the present invention directs lateral rocking motion having the basic trajectory of pendulum swing type motion into a user's lower back when a user is seated thereupon. To achieve this basic function, the lower back exercise apparatus comprises a lower base assembly, an upper seat assembly, and a motor assembly.

Again referencing FIG. 41, the reader will there note a diagrammatic depiction of a simple gravity pendulum showing a frictionless pivot as at fulcrum 100, a massless rod as at 110, and a massive bob as at 121 with a defined angular amplitude as at 101; an equilibrium position as at 112, and an overall bob trajectory 113 having left and right lateral displacements as at vectors 114 and upward displacements as at 115 relative to a horizontal line as at 116 tangent to the equilibrium position 112.

Central to the practice of the present invention is how the lower back exercise apparatus imparts motion of trajectory 113 into a user's lumbar region 40. Without the need for upper body shift or movement, the lower back exercise apparatus imparts via either of its contemplated mechanizations such motion or displacements with basic or component vectors 114 (lateral displacements) and 115 (upward displacements). The phrase "without the need of upper body movement" has repeatedly appeared throughout these specifications.

The reason that the upper body of a user can be stationary while the lumbar spine is "bending" is because the sitting surface of the seat is mechanically rotating around a point adjacent an upper section of the lumbar spine. This rotational seat motion causes only the lumbar spine to "bend" following the path of a pendulum "swing", which allows everything above the pivot point, i.e. human upper body, to remain stationary. Thus, the lumbar spine movement is isolated by the present invention as various exemplified.

Unlike a tilting seat arrangement, the bending of the lumbar spine requires the both lateral and vertical motions of human upper body, which is not desirable during a reading and working environment. The reader will note that the above statement is true for both a mechanized seat and a free moving seat as long as the seat is rotating following the path of a pendulum swing. The prior art appears to be silent on an invention of this particular type and thus perceives a need for a lower back exercise apparatus for imparting preferred mechanized motion with mechanically controlled lateral and upward displacements.

The lower base assembly comprises or includes an upper, laterally concave base surface, which upper, laterally concave base surface comprises or includes a base radius of curvature. The upper seat assembly comprises or includes a lower, laterally convex seat surface and an upper seat surface. The lower, laterally convex seat surface comprises or includes a seat radius of curvature that coincides with the base radius of curvature. The upper seat assembly is ridable upon and movable relative to the lower base assembly.

The motor assembly is cooperably associated with the lower base assembly and the upper seat assembly for effecting a lateral rocking motion of the upper seat assembly relative to the lower base assembly defined, at least in part, by the base and seat radii of curvature. The base and seat radii of curvature have a common fulcrum point, which common fulcrum point is spatially located adjacent an upper portion of a user's lumbar spinal region such that the lateral rocking motion directs lateral rocking motion with lateral and upward movements defined by movement along an arc length typified by pendulum swing motion where the base and seat radii of curvature are analogous to the length of a massless rod of an ideal pendulum.

The lower back exercise apparatus according to the present invention may further preferably comprise at least one series of seat support bearing assemblies cooperable with the lower base assembly and the upper seat assembly for enhancing movement of the upper seat assembly relative to the lower base assembly. Further, as in the case of the embodiment 12 of the lower back exercise apparatus, in particular, the motor assembly 37 may be cooperable with an arc length gear section as at or in cover gear 49. The arc length gear section 49 is preferably parallel to the upper, laterally concave base surface and lower, laterally convex seat surface and is cooperable with the motor assembly for defining a trajectory and an amplitude of the lateral rocking motion. Alternatively, as in the case of the embodiment 11 of the lower back exercise apparatus, the motor assembly 37 may well comprise a cable-winch assembly as at 44/45. The cable-winch assembly provides a rotary to linear displacement capability for effecting the lateral rocking motion.

The lower back exercise apparatus may further comprise or include a matable upper-to-lower alignment mechanism for maintaining alignment of the upper seat assembly relative to the lower base assembly during the lateral rocking motion along the cylindrical arc length trajectory defined by the upper, laterally concave surface and the lower, laterally convex surface. A period control input and an amplitude control input as at the knobs 48 of the control panel 42 are in electrical communication with the motor assembly and enable the user to control periodicity and amplitude. The lower back exercise apparatus according to the present invention may be either a portable stand-alone unit or apparatus or built-into a combination chair construction 15 as generally depicted in FIGS. 37-40C.

Stated another way, the lower back or lumbar spine exercise apparatus according to the present invention may be said to preferably and essentially comprise a base assembly; a seat assembly; and a preferred, but optional motor assembly. The seat assembly is laterally movable along a cylindrical arc length trajectory relative to the lower base assembly. The preferred, but optional motor assembly is cooperably associated with the base assembly and the seat assembly for driving lateral movements along the cylindrical arc length trajectory and imparting laterally and upwardly directed flexion movements into a user's lower back when seated upon the seat assembly.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures, the appended drawings submitted in support of these specifications, and the following claims.

What is claimed is:

1. A manually-operated lower back exercise apparatus for exercising a user's lower back when the user is seated thereupon and manually drives said apparatus, the manually-operated lower back exercise apparatus comprising:

a lower base assembly, the lower base assembly comprising an upper cylindrical base surface, the upper cylindrical base surface comprising an upper-lateral arc length and a uniform base radius of curvature along said upper-lateral arc length;

an upper seat assembly, the upper seat assembly comprising a lower cylindrical seat surface and an upper seat surface, the lower cylindrical seat surface comprising a lower-lateral arc length and a uniform seat radius of curvature along said lower-lateral arc length, the uniform seat radius of curvature coinciding with the uniform base radius of curvature, the upper seat assembly being ridable upon and movable relative to the lower base assembly, the upper seat assembly being movable relative to the lower base assembly along a fixed and laterally directed, two-dimensional cylindrical arc length trajectory; and at least one series of in-line seat support bearing assemblies and at least one bearing-receiving track, the at least one series of in-line seat support bearing assemblies being received in and operable via the at least one bearing-receiving track, the at least one series of in-line seat support bearing assemblies and the at least one bearing-receiving track being cooperable with the lower base assembly and the upper seat assembly for enhancing movement of the upper seat assembly relative to the lower base assembly;

the uniform base and seat radii of curvature having a common fulcrum point and a purposed dimension, the purposed dimension for positioning the common fulcrum point adjacent an upper portion of the user's lumbar spinal region, the manually-operated lower back exercise apparatus thus for two-dimensionally exercising the user's lumbar spinal region when the user is seated thereupon and manually drives said apparatus.

2. The manually-operated lower back exercise apparatus of claim 1 wherein the at least one series of in-line seat support bearing assemblies is defined by laterally spaced sets of in-line seat support bearings, and the at least one bearing-receiving track is defined by longitudinally spaced bearing-receiving tracks, the laterally spaced sets of in-line seat support bearings and the longitudinally spaced bearing-receiving tracks being laterally offset from one another and parallel for enhancing movement of the upper seat assembly relative to the lower base assembly.

3. The manually-operated lower back exercise apparatus of claim 1 comprising a matable upper-to-lower alignment mechanism for maintaining alignment of the upper seat assembly relative to the lower base assembly during manually-driven movement of the upper seat assembly relative to the lower base assembly.

4. The manually-operated lower back exercise apparatus of claim 1 wherein the lower base assembly comprise a lower central pedestal section, the lower central pedestal section comprising laterally opposed bearing-accommodating sections for structurally accommodating laterally spaced sets of in-line seat support bearings.

5. The manually-operated lower back exercise apparatus of claim 1 wherein the lower base assembly is integrally formed with a chair construction.

6. A manual lower back exercise apparatus, the manual lower back exercise apparatus comprising:

a lower base assembly, the lower base assembly comprising an upper cylindrical base surface, the upper cylindrical base surface comprising a base radius of curvature;

an upper seat assembly, the upper seat assembly comprising a lower cylindrical seat surface and an upper seat surface, the lower cylindrical seat surface comprising a seat radius of curvature coinciding with the base radius of curvature, the upper seat assembly being ridable upon and movable relative to the lower base assembly for imparting lateral and upward displacements of the upper seat assembly relative to the lower base assembly defined by the base and seat radii of curvature within a fixed and laterally directed, two-dimensional cylindrical arc length trajectory; and at least one series of in-line seat support bearing assemblies and at least one bearing-receiving track, the at least one series of in-line seat support bearing assemblies being received in and operable via the at least one bearing-receiving track, the at least one series of in-line seat support bearing assemblies and the at least one bearing-receiving track being cooperable with the lower base assembly and the upper seat assembly for enhancing movement of the upper seat assembly relative to the lower base assembly;

the base and seat radii of curvature having a common fulcrum point and a purposed dimension, the purposed dimension for positioning the common fulcrum point at an upper portion of a user's lumbar spinal region such that the lateral and upward displacements of the upper seat assembly relative to the lower base assembly direct isolated lumbar spine motion into the user's lower back when seated thereupon and manually drives said apparatus.

7. The manual lower back exercise apparatus of claim 6 comprising a matable upper-to-lower alignment mechanism for maintaining alignment of the upper seat assembly relative to the lower base assembly during the lateral and upward displacements of the upper seat assembly relative to the lower base assembly.

8. The manual lower back exercise apparatus of claim 6 wherein the lower base assembly is integrally formed with a chair construction.

9. A manual lower back exercise apparatus, the manual lower back exercise apparatus comprising:

a base assembly, the base assembly comprising an upper cylindrical base surface;

a seat assembly, the seat assembly comprising a lower cylindrical seat surface, the seat assembly being movable in a fixed and laterally directed, two-dimensional cylindrical arc length trajectory relative to the base assembly; and at least one series of in-line seat support bearing assemblies and at least one bearing-receiving track, the at least one series of in-line seat support bearing assemblies being received in and operable via the at least one bearing-receiving track, the at least one series of in-line seat support bearing assemblies and the at least one bearing-receiving track being cooperable with the base assembly and the seat assembly for enhancing movement of the seat assembly relative to the base assembly;

a user being seatable atop the seat assembly for manually driving the seat assembly relative to the base assembly along the fixed and laterally directed, two-dimensional cylindrical arc length trajectory and imparting laterally and upwardly directed flexion movements into the user's lower back when the user is seated upon the seat assembly and manually drives said apparatus.

10. The manual lower back exercise apparatus of claim 9 wherein the base assembly comprises a lower central pedestal section, the lower central pedestal section comprising at least one bearing-accommodating section for structurally accommodating the at least one series of in-line seat support bearing assemblies.

11. The manual lower back exercise apparatus of claim 9 wherein the upper cylindrical base surface and the lower cylindrical seat surface comprise uniform radii of curvature having a common fulcrum point and a purposed dimension, the purposed dimension for positioning the common fulcrum point at an upper portion of a user's lumbar spinal region, the lower back exercise apparatus thus for two-dimensionally exercising the user's lumbar spinal region when the user is seated thereupon and manually drives said apparatus.

12. The manual lower back exercise apparatus of claim 9 wherein the base assembly is integrally formed with a chair construction.

* * * * *